US011946666B2

(12) United States Patent
Kagawa et al.

(10) Patent No.: US 11,946,666 B2
(45) Date of Patent: Apr. 2, 2024

(54) AIR CONDITIONER

(71) Applicant: DAIKIN INDUSTRIES, LTD., Osaka (JP)

(72) Inventors: Mikio Kagawa, Osaka (JP); Junichi Shimoda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 498 days.

(21) Appl. No.: 17/272,533

(22) PCT Filed: Aug. 31, 2018

(86) PCT No.: PCT/JP2018/032362
§ 371 (c)(1),
(2) Date: Mar. 1, 2021

(87) PCT Pub. No.: WO2020/044539
PCT Pub. Date: Mar. 5, 2020

(65) Prior Publication Data

US 2021/0325081 A1 Oct. 21, 2021

(51) Int. Cl.
*F24F 13/20* (2006.01)
*F24F 1/16* (2011.01)
(Continued)

(52) U.S. Cl.
CPC ..... *F24F 13/20* (2013.01); *F24F 1/16* (2013.01); *F24F 11/36* (2018.01); *F24F 11/89* (2018.01); *F24F 13/30* (2013.01)

(58) Field of Classification Search
CPC .. F24F 13/20; F24F 11/89; F24F 11/36; F24F 1/16; F24F 1/02; F24F 1/028;
(Continued)

(56) References Cited

U.S. PATENT DOCUMENTS 6,536,225 B1 3/2003 Yajima
2017/0102157 A1* 4/2017 Goodjohn ..... F25B 13/00

FOREIGN PATENT DOCUMENTS

JP H08-61702 A 3/1996
JP H10-281569 A 10/1998
(Continued)

OTHER PUBLICATIONS

Pdf is translation of foreign reference WO-2017199340-A1 (Year: 2017).*
(Continued)

*Primary Examiner* — Len Tran
*Assistant Examiner* — Kamran Tavakoldavani
(74) *Attorney, Agent, or Firm* — Osha Bergman Watanabe & Burton LLP

(57) ABSTRACT

An air conditioner includes: a casing; a partition plate in the casing that separates a heat-source-side space of the casing through which outdoor air passes and a utilization-side space of the casing through which indoor air passes and blocks air flow between the heat-source-side space and the utilization-side space; a heat-source-side heat exchanger in the heat-source-side space that causes heat exchange between a refrigerant and the outdoor air; a utilization-side heat exchanger in the utilization-side space that causes heat exchange between the indoor air and the heat-exchanged refrigerant; a duct that extends from the utilization-side space to an indoor air conditioning target space; and a refrigerant leakage sensor in the utilization-side space that detects leaked refrigerant in the utilization-side space.

9 Claims, 25 Drawing Sheets

(51) Int. Cl.
*F24F 11/36* (2018.01)
*F24F 11/89* (2018.01)
*F24F 13/30* (2006.01)

(58) Field of Classification Search
CPC ..... F24F 1/0323; F24F 13/30; F24F 3/044; F24F 2221/16; F25B 2500/22; F25B 2500/222
See application file for complete search history.

(56) References Cited

FOREIGN PATENT DOCUMENTS

| | | | | | |
|---|---|---|---|---|---|
| JP | 2000-258000 | A | | 9/2000 | |
| JP | 2000258000 | A | * | 9/2000 | ..... F24F 1/02 |
| JP | 2007-127388 | A | | 5/2007 | |
| WO | WO-2017199340 | A1 | * | 11/2017 | ..... F24F 11/89 |

OTHER PUBLICATIONS

Pdf is translation of foreign reference JP-2000258000-A (Year: 2000).*
Pdf is original document of foreign reference JP-2000258000-A (Year: 2000).*
International Search Report issued in corresponding International Application No. PCT/JP2018/032362 dated Oct. 23, 2018 (5 pages).
International Preliminary Report on Patentability issued for PCT/JP2018/032362, dated Mar. 2, 2021 (7 pages).

* cited by examiner

AIR CONDITIONER

TECHNICAL FIELD

An air conditioner, especially an air conditioner installed on a rooftop of a building.

BACKGROUND

Air conditioners include a so-called rooftop air conditioner installed on a rooftop of a building that is outdoors and having a heat-source-side heat exchanger and a utilization-side heat exchanger that are arranged in one unit. Such a rooftop air conditioner air-conditions a plurality of rooms in the building, or the entire building in some cases, via a duct from the unit equipped with both the heat-source-side heat exchanger and the utilization-side heat exchanger. In such a rooftop air conditioner, a vapor compression refrigeration cycle is performed using refrigerant such as R32 refrigerant, R410A refrigerant, or carbon dioxide, for example, as described in Patent Literature 1 (JP 2000-258000 A).

Meanwhile, since the refrigerant such as R32 refrigerant used in the rooftop air conditioner is heavier than air, there is a possibility of the refrigerant entering a room in the building through the duct from the unit at a high position in the building if the refrigerant leaks in the unit, especially around the utilization-side heat exchanger.

Therefore, in the rooftop air conditioner as described above, there is an issue of suppressing entering of the refrigerant into the building through the duct when the refrigerant leaks in the unit of the air conditioner.

SUMMARY

According to one or more embodiments, an air conditioner according to a first aspect includes:

- a casing having a partition plate that separates a heat-source-side space through which outdoor air passes and a utilization-side space through which indoor air passes, to block a flow of air between the heat-source-side space and the utilization-side space;
- a heat-source-side heat exchanger that is arranged in the heat-source-side space of the casing and causes heat exchange between refrigerant and outdoor air;
- a utilization-side heat exchanger that is arranged in the utilization-side space of the casing and causes heat exchange between indoor air and refrigerant that has been heat-exchanged by the heat-source-side heat exchanger;
- a duct extending from an indoor air conditioning target space to be connected to the casing to communicate with the utilization-side space; and
- at least one refrigerant leakage sensor that is arranged in the utilization-side space of the casing and detects refrigerant leaked in the utilization-side space.

According to one or more embodiments, an air conditioner according to a second aspect is the air conditioner according to the first aspect, in which the refrigerant leakage sensor includes a first refrigerant leakage sensor arranged in the utilization-side space and downstream of the utilization-side heat exchanger in an airflow of indoor air.

According to one or more embodiments, an air conditioner according to a third aspect is the air conditioner according to the first aspect, in which the refrigerant that is heat-exchanged by the utilization-side heat exchanger is refrigerant heavier than air when being vaporized, and the refrigerant leakage sensor includes a second refrigerant leakage sensor arranged at a lowermost portion of the utilization-side space.

According to one or more embodiments, an air conditioner according to a fourth aspect is the air conditioner according to the first aspect, in which the refrigerant that is heat-exchanged by the utilization-side heat exchanger is refrigerant heavier than air when being vaporized, and the refrigerant leakage sensor includes a first refrigerant leakage sensor arranged in the utilization-side space and downstream of the utilization-side heat exchanger in an airflow of indoor air, and includes a second refrigerant leakage sensor arranged at a lowermost portion of the utilization-side space.

According to one or more embodiments, an air conditioner according to a fifth aspect is the air conditioner according to the first aspect, in which the refrigerant that is heat-exchanged by the utilization-side heat exchanger is refrigerant heavier than air when being vaporized, and the refrigerant leakage sensor includes a third refrigerant leakage sensor arranged below a brazed part of a refrigerant pipe in the utilization-side space.

According to one or more embodiments, an air conditioner according to a sixth aspect includes:

- a casing having a partition plate that separates a heat-source-side space through which outdoor air passes and a utilization-side space through which indoor air passes, to block a flow of air between the heat-source-side space and the utilization-side space, and having a bottom plate that has a first opening for supply air and a second opening for return air and closes a bottom surface of the utilization-side space;
- a heat-source-side heat exchanger that is arranged in the heat-source-side space of the casing and causes heat exchange between refrigerant and outdoor air;
- a utilization-side heat exchanger that is arranged in the utilization-side space of the casing and causes heat exchange between indoor air and refrigerant that has been heat-exchanged by the heat-source-side heat exchanger;
- a first duct extending from an indoor air conditioning target space to be connected to the first opening of the utilization-side space, and a second duct extending from an indoor air conditioning target space to be connected to the second opening of the utilization-side space; and
- a standing part surrounding a periphery of at least one of the first opening or the second opening.

According to one or more embodiments, an air conditioner according to a seventh aspect is the air conditioner according to the sixth aspect, in which the standing part has a height equal to or greater than a value obtained by dividing a refrigerant amount of the refrigerant circulating in the heat-source-side heat exchanger and the utilization-side heat exchanger, by an area of a place where the refrigerant stays and accumulates.

According to one or more embodiments, an air conditioner according to an eighth aspect is the air conditioner according to the sixth aspect, in which the partition plate has a damper to connect the heat-source-side space with the utilization-side space.

According to one or more embodiments, an air conditioner according to a ninth aspect is the air conditioner according to the sixth aspect, in which the standing part is formed by a member different from the bottom plate.

According to one or more embodiments, an air conditioner according to a tenth aspect is the air conditioner according to the ninth aspect, in which the standing part is made of resin and has a shape expanding upward.

According to one or more embodiments, an air conditioner according to an eleventh aspect is the air conditioner according to the sixth aspect, in which a height position of an upper end of the standing part is adapted to reach a vicinity of a height position of a lower end of the utilization-side heat exchanger.

According to one or more embodiments, an air conditioner according to a twelfth aspect includes:

a casing having a partition plate that separates a heat-source-side space through which outdoor air passes and a utilization-side space through which indoor air passes, to block a flow of air between the heat-source-side space and the utilization-side space, and having a bottom plate that has a first opening for supply air and a second opening for return air and closes a bottom surface of the utilization-side space;

a heat-source-side heat exchanger that is arranged in the heat-source-side space of the casing and causes heat exchange between refrigerant and outdoor air;

a utilization-side heat exchanger that is arranged in the utilization-side space of the casing and causes heat exchange between indoor air and refrigerant that has been heat-exchanged by the heat-source-side heat exchanger;

a first duct extending from an indoor air conditioning target space to be connected to the first opening of the utilization-side space, and a second duct extending from an indoor air conditioning target space to be connected to the second opening of the utilization-side space; and a refrigerant pipe having a connection part that is connected to a refrigerant circuit including the utilization-side heat exchanger and the heat-source-side heat exchanger and is arranged in the utilization-side space.

In top view, the connection part of the refrigerant pipe is arranged at a position that does not overlap with the first opening and the second opening.

According to one or more embodiments, an air conditioner according to a thirteenth aspect is the air conditioner according to the twelfth aspect, in which the refrigerant pipe is arranged at a position that does not overlap with the first opening and the second opening in top view.

According to one or more embodiments, an air conditioner according to a fourteenth aspect is the air conditioner according to the thirteenth aspect, in which the utilization-side heat exchanger is arranged to be inclined.

According to one or more embodiments, an air conditioner according to a fifteenth aspect includes:

a casing having a partition plate that separates a heat-source-side space through which outdoor air passes and a utilization-side space through which indoor air passes, to block a flow of air between the heat-source-side space and the utilization-side space, and having a bottom plate that has a first opening for supply air and a second opening for return air and closes a bottom surface of the utilization-side space;

a heat-source-side heat exchanger that is arranged in the heat-source-side space of the casing and causes heat exchange between refrigerant and outdoor air;

a utilization-side heat exchanger that is arranged in the utilization-side space of the casing and causes heat exchange between indoor air and refrigerant that has been heat-exchanged by the heat-source-side heat exchanger;

a first duct extending from an indoor air conditioning target space to be connected to the first opening of the utilization-side space, and a second duct extending from an indoor air conditioning target space to be connected to the second opening of the utilization-side space; and a refrigerant pipe having a connection part that is connected to a refrigerant circuit including the utilization-side heat exchanger and the heat-source-side heat exchanger.

The casing further has a surrounding part that surrounds a connection-part space to communicate with an external space and/or the heat-source-side space and not to communicate with the utilization-side space, and the connection part is arranged in the connection-part space.

According to one or more embodiments, an air conditioner according to a sixteenth aspect is the air conditioner according to the fifteenth aspect, further including: a heat-source-side fan that generates an airflow passing through the heat-source-side heat exchanger; and at least one refrigerant leakage sensor that detects refrigerant leaked into the utilization-side space. The partition plate has a damper that connects the utilization-side space with the heat-source-side space by being opened, and the damper is opened and the heat-source-side fan is driven when refrigerant is detected in the utilization-side space by the refrigerant leakage sensor.

According to one or more embodiments, an air conditioner according to a seventeenth aspect is the air conditioner according to the sixteenth aspect, in which the damper is adapted to close the first opening and/or the second opening when being opened.

DETAILED DESCRIPTION

First Embodiment

(1) Overall Configuration

Figure 1:
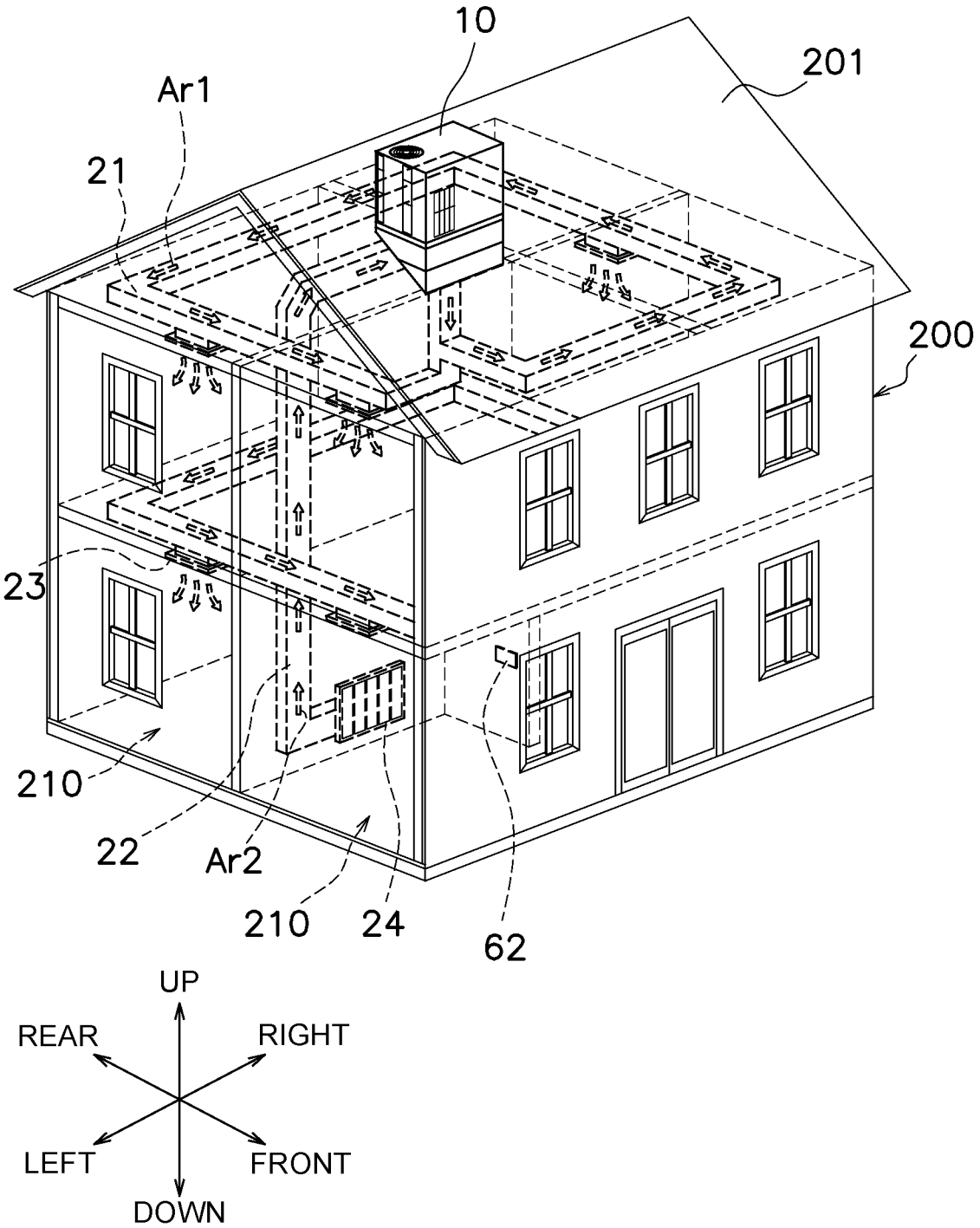
FIG. 1 is a perspective view showing an installation state of an air conditioner in a building, according to a first embodiment.

As shown in FIG. 1, an air conditioner 10 according to a first embodiment is installed on a roof 201 of a building 200, that is, on a rooftop. The air conditioner 10 is equipment that air-conditions a room that is inside the building 200. The building 200 has a plurality of rooms 210. The room 210 of the building 200 is to be an air conditioning target space for the air conditioner 10. FIG. 1 shows an example in which the air conditioner 10 includes one duct 21 and one duct 22. However, the air conditioner 10 can also include a plurality of the ducts 21 and the ducts 22 individually. Note that the duct 21 shown in FIG. 1 is branched in a middle. The duct 21 is provided for supply air, and the duct 22 is provided for return air. In FIG. 1, arrows Ar1 and Ar2 in the ducts 21 and 22 indicate directions in which air in the ducts 21 and 22 is flowing. Air is sent from the air conditioner 10 to the room 210 through the duct 21, and indoor air in the room 210, which is air in the air conditioning target space, is sent to the air conditioner 10 through the duct 22. At a boundary between the duct 21 and the room 210, a plurality of blow-out ports 23 are provided. Supply air supplied through the duct 21 is blown out from the blow-out ports 23 to the room 210. Further, at a boundary between the duct 22 and the room 210, at least one suction port 24 is provided. Indoor air suctioned from the suction port 24 becomes return air to be returned to the air conditioner 10 by the duct 22.

(2) Appearance of Air Conditioner 10

Figure 2:
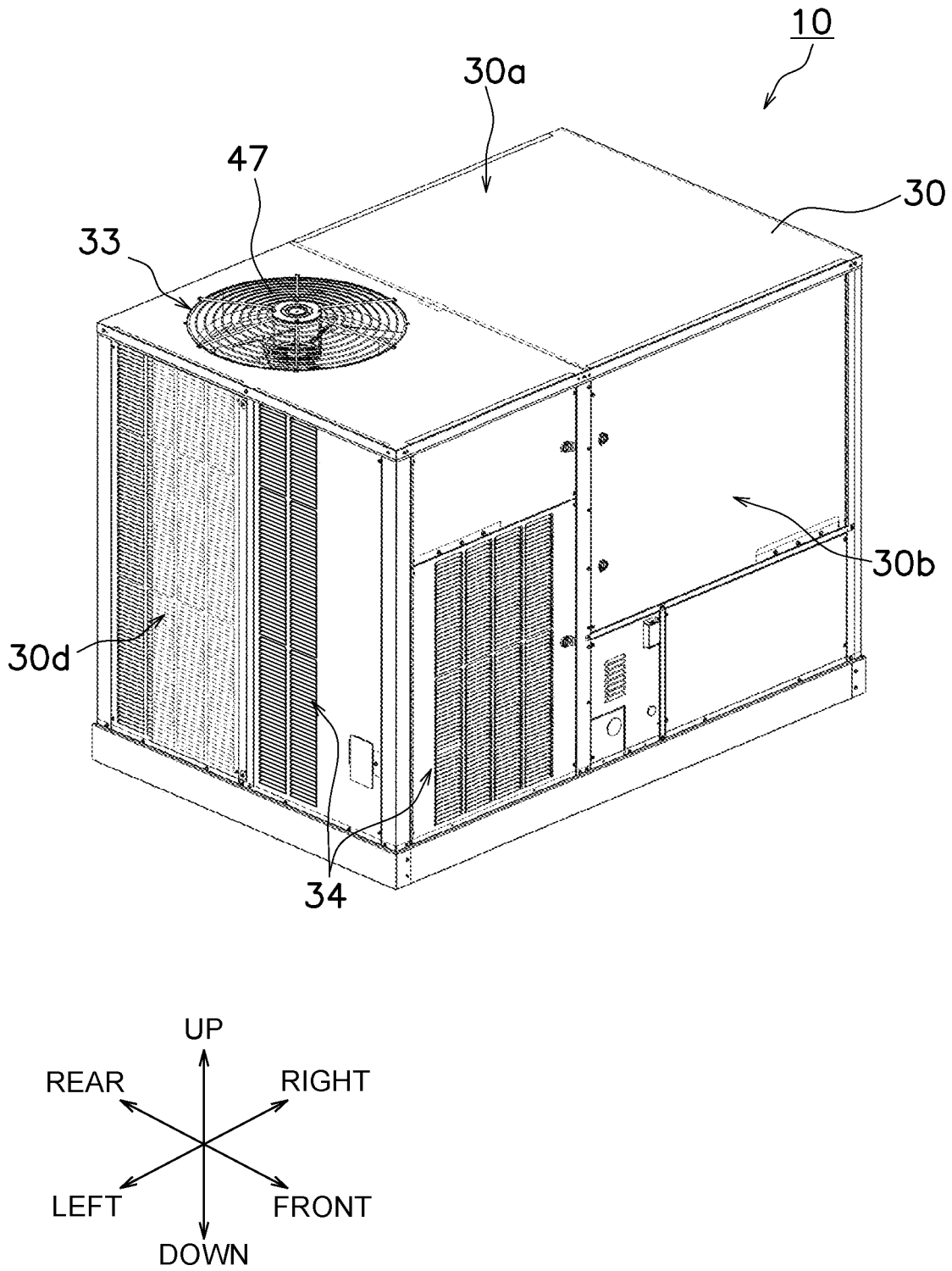
FIG. 2 is a perspective view showing an appearance of the air conditioner.
Figure 3:
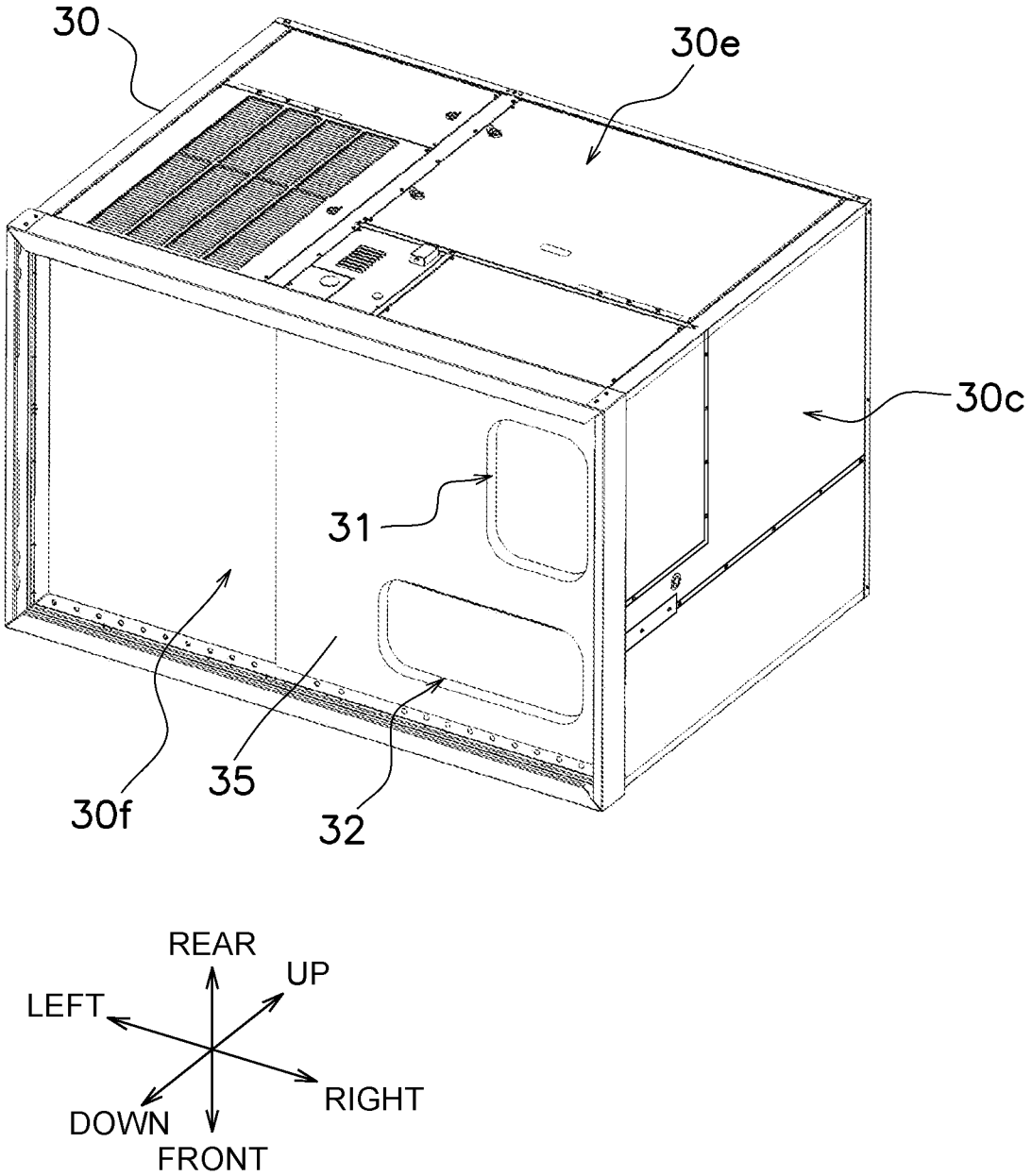
FIG. 3 is a perspective view showing an appearance of the air conditioner.

FIG. 2 shows an appearance of the air conditioner 10 when the air conditioner 10 is viewed from diagonally above, and FIG. 3 shows an appearance of the air conditioner 10 when the air conditioner 10 is viewed from diagonally below. In the following, for convenience, a description is given with use of directions, up, down, front, rear, left, and right shown by arrows in the figure. The air conditioner 10 includes a casing 30 having a shape based on a rectangular parallelepiped. The casing 30 includes a metal plate covering a top surface 30*a*, a front surface 30*b*, a right side surface 30*c*, a left side surface 30*d*, a back surface 30*e*, and a bottom surface 30*f*. The casing 30 has a third opening 33 on the top surface 30*a*. This third opening 33 communicates with a heat-source-side space SP1 (see FIG. 4). The third opening 33 is attached with a heat-source-side fan 47 that blows air from the heat-source-side space SP1 toward outside the casing 30 through the third opening 33. For the heat-source-side fan 47, for example, a propeller fan is used. Further, the casing 30 has slits 34 on the front surface 30*b*, the left side surface 30*d*, and the back surface 30*e*. These slits 34 also communicate with the heat-source-side space SP1. When air is blown out from the heat-source-side space SP1 toward outside the casing 30 by the heat-source-side fan 47, since the heat-source-side space SP1 is to have negative pressure with respect to atmospheric pressure, outdoor air is suctioned into the heat-source-side space SP1 from the outside of the casing 30 through the slits 34. Note that the third opening 33 and the slits 34 do not communicate with a utilization-side space SP2 (see FIG. 4). Therefore, in a normal state, there is no place where the utilization-side space SP2 communicates with the outside of the casing 30, other than the ducts 21 and 22.

Figure 8:
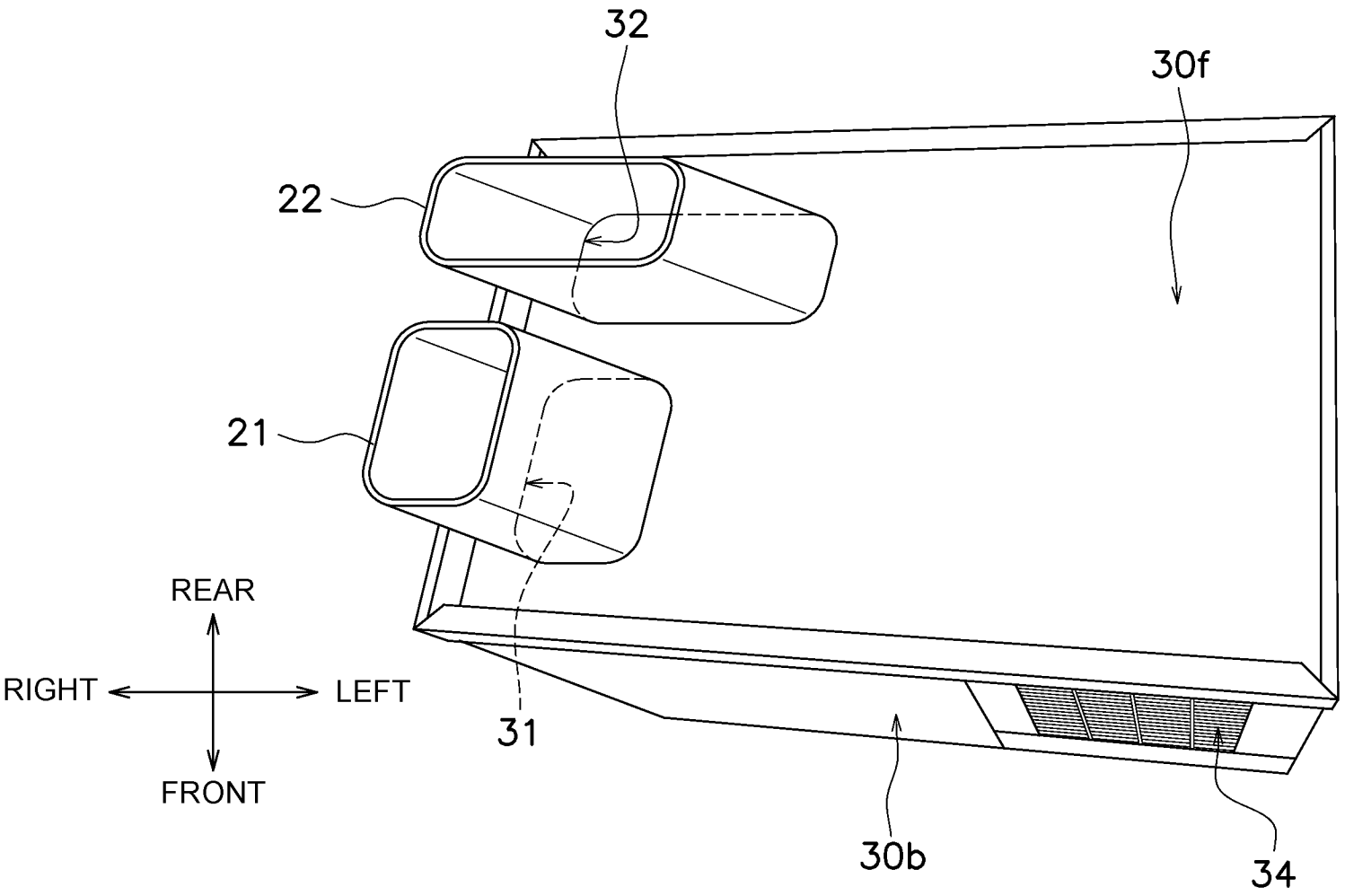
FIG. 8 is a perspective view for explaining a duct of the air conditioner.

The bottom surface 30*f* of the casing 30 is attached with a bottom plate 35 having a first opening 31 and a second opening 32. To the first opening 31 for supply air, the duct 21 is connected as shown in FIG. 8. Further, to the second opening 32 for return air, the duct 22 is connected as shown in FIG. 8. Air that has returned from the room 210, which is the air conditioning target space, through the duct 22 to the utilization-side space SP2 of the casing 30 is sent from the utilization-side space SP2 to the room 210 through the duct 21. At a periphery of the first opening 31 and the second opening 32, ribs 31*a* and 32*a* having a height of less than 3 cm are formed in order to reinforce strength of the bottom plate 35 (see FIG. 5). When the first opening 31 and the second opening 32 are formed on the bottom plate 35 by, for example, press molding, the ribs 31*a* and 32*a* are formed integrally with the bottom plate 35 by erecting a metal plate, which is a material of the bottom plate 35, by press molding.

(3) Internal Configuration of Air Conditioner 10

(3-1) Heat-Source-Side Space SP1 and Utilization-Side Space SP2 in Casing 30

Figure 4:
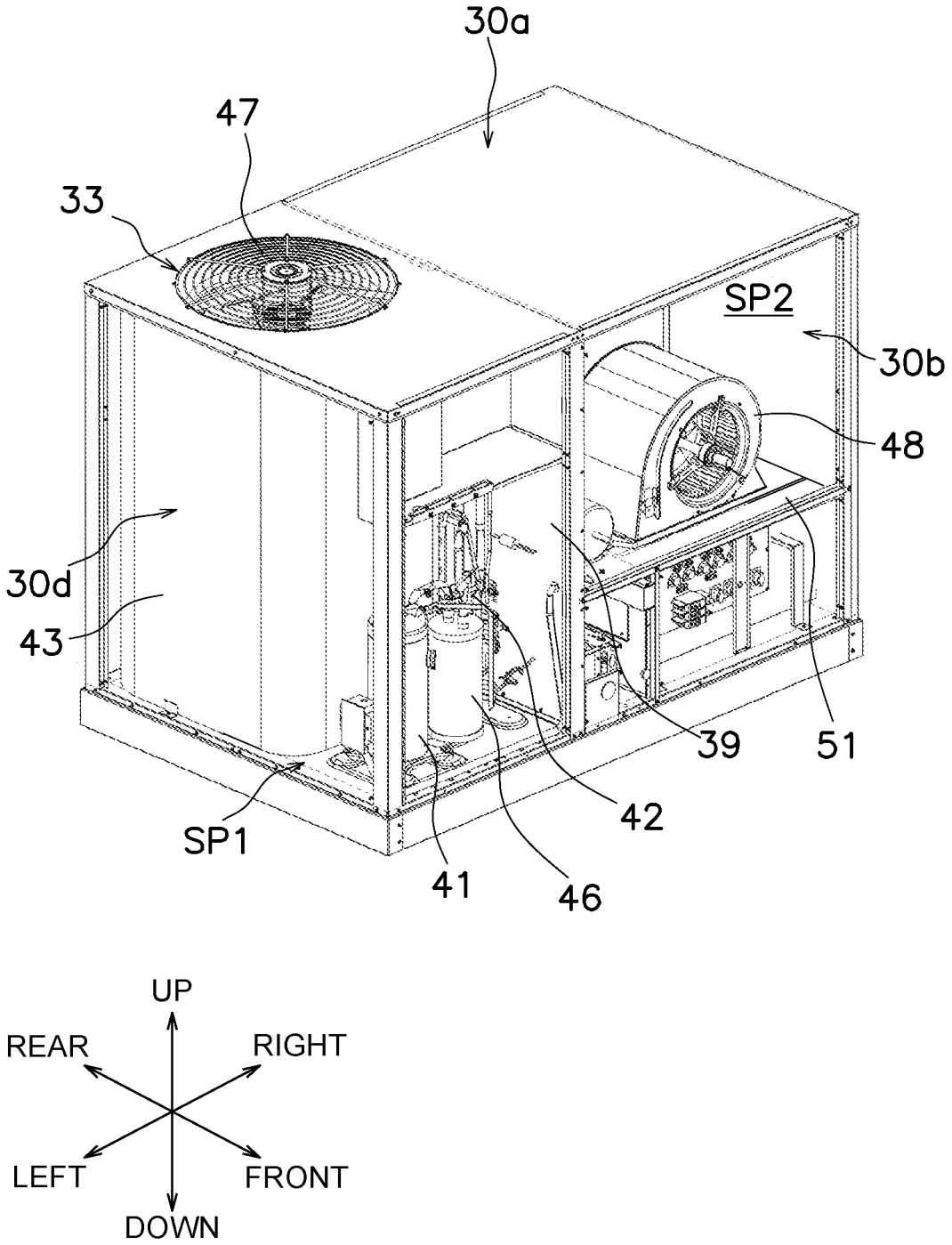
FIG. 4 is a perspective view for explaining an internal configuration of the air conditioner.
Figure 5:
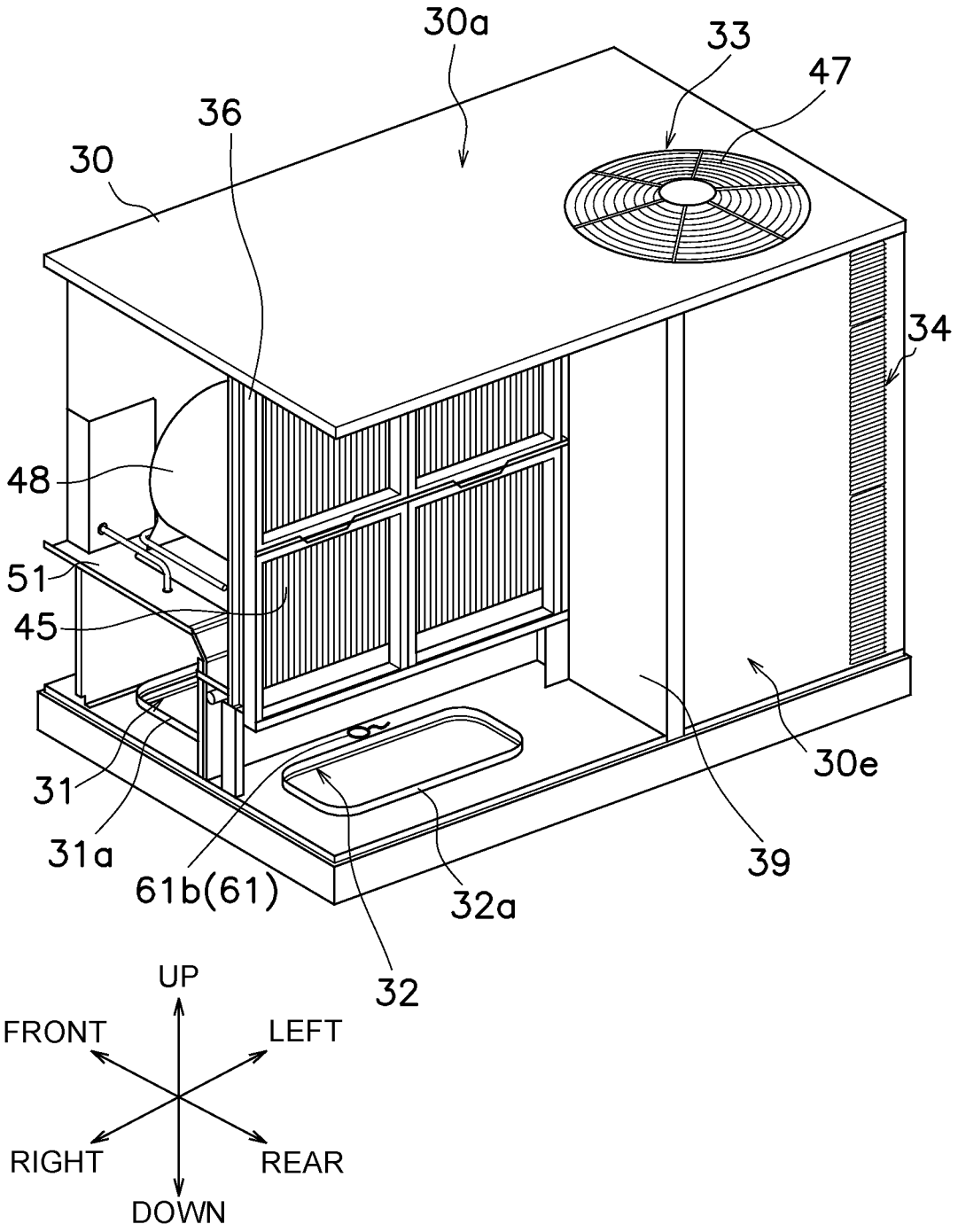
FIG. 5 is a perspective view for explaining an internal configuration of the air conditioner.
Figure 7:
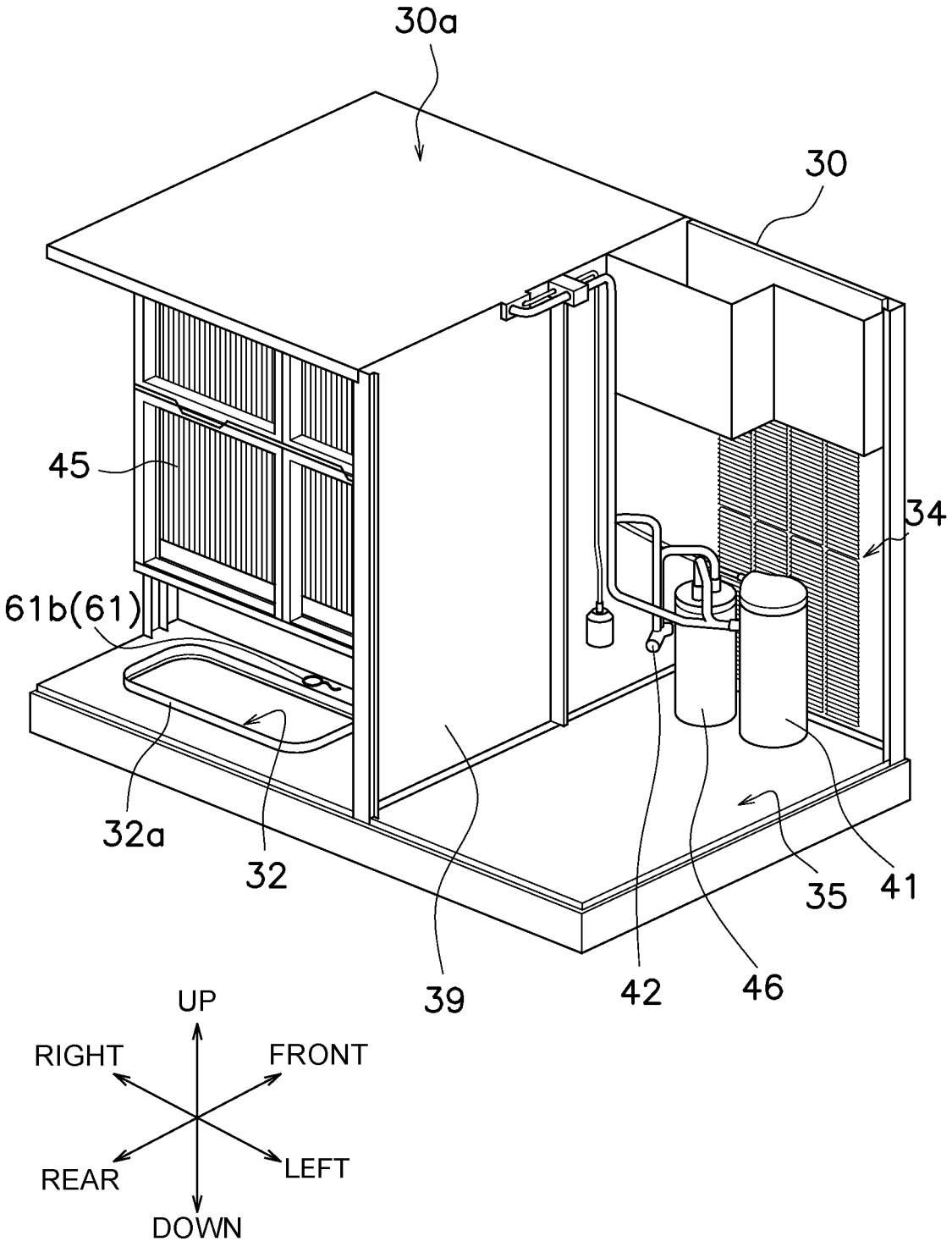
FIG. 7 is a perspective view for explaining an internal configuration of the air conditioner.

FIG. 4 shows a state in the casing 30 where a metal plate that has been covering the front surface 30*b* and a metal plate that has been covering the left side surface 30*d* are removed. FIG. 5 shows a state in the casing 30 where a metal plate that has been covering the right side surface 30*c* and a part of a metal plate that has been covering the back surface 30*e* are removed. In FIG. 5, the removed metal plate in the metal plate that has been covering the back surface 30*e* is a metal plate that has been covering the utilization-side space SP2. Therefore, a metal plate covering the back surface 30*e* shown in FIG. 5 covers only the heat-source-side space SP1. Then, FIG. 7 shows a state in the casing 30 where the metal plate that has been covering the right side surface 30*c*, the metal plate that has been covering the left side surface 30*d*, the metal plate that has been covering the back surface 30*e*, and the metal plate that has been covering a part of the top surface 30*a* are removed, and the heat-source-side heat exchanger 43 and the heat-source-side fan 47 are removed.

The heat-source-side space SP1 and the utilization-side space SP2 are separated by a partition plate 39. While outdoor air flows in the heat-source-side space SP1 and indoor air flows in the utilization-side space SP2, the partition plate 39 blocks a flow of air between the heat-source-side space SP1 and the utilization-side space SP2 by separating the heat-source-side space SP1 and the utilization-side space SP2. Therefore, in a normal state, indoor air and outdoor air do not mix in the casing 30, and there is no communication between outdoors and indoors through the air conditioner 10.

(3-2) Configuration in Heat-Source-Side Space SP1

In addition to the heat-source-side fan 47, the heat-source-side space SP1 also accommodates a compressor 41, a four-way valve 42, the heat-source-side heat exchanger 43, and an accumulator 46. The heat-source-side heat exchanger 43 includes a plurality of heat transfer tubes (not shown) through which refrigerant flows, and a plurality of heat transfer fins (not shown) in which air flows through gaps between with each other. The plurality of heat transfer tubes are arranged aligned in an up-down direction (hereinafter, also referred to as a row direction), and each heat transfer tube extends in a direction (substantially in a horizontal direction) substantially orthogonal to the up-down direction. Further, the plurality of heat transfer tubes are provided in a plurality of rows in order from a side closest to the casing 30. At an end portion of the heat-source-side heat exchanger 43, for example, the heat transfer tubes are bent in a U shape or connected to each other by a U-shaped tube such that a flow of the refrigerant is folded back from one column to another column and/or from one row to another row. The plurality of heat transfer fins extending long in the up-down direction are arranged along an extending direction of the heat transfer tubes at a predetermined distance from each other. The plurality of heat transfer fins and the plurality of heat transfer tubes are combined such that the plurality of heat transfer tubes penetrate individual heat transfer fins. Then, the plurality of heat transfer fins are also arranged in a plurality of rows.

The heat-source-side heat exchanger 43 has a C-shape in top view, and is arranged so as to face the front surface 30*b*, the left side surface 30*d*, and the back surface 30*e* of the casing 30. A portion not surrounded by the heat-source-side heat exchanger 43 is a portion facing the partition plate 39. Then, side end portions corresponding to two end portions of the C-shape are arranged near the partition plate 39, and a space between the two side end portions of the heat-source-side heat exchanger 43 and the partition plate 39 is closed by a metal plate (not shown) that blocks passage of air. Further, the heat-source-side heat exchanger 43 has a height substantially reaching from the bottom surface 30*f* to the top surface 30*a* of the casing 30. Such a configuration allows formation of a flow path of air that enters through the slit 34, passes through the heat-source-side heat exchanger 43, and exits from the third opening 33. Outdoor air suctioned into the heat-source-side space SP1 through the slit 34 exchanges heat with the refrigerant flowing in the heat-source-side heat exchanger 43, when passing through the heat-source-side heat exchanger 43. The air after heat exchange in the heat-source-side heat exchanger 43 is exhausted from the third opening 33 to the outside of the casing 30 by the heat-source-side fan 47.

(3-3) Configuration in Utilization-Side Space SP2

Figure 12:
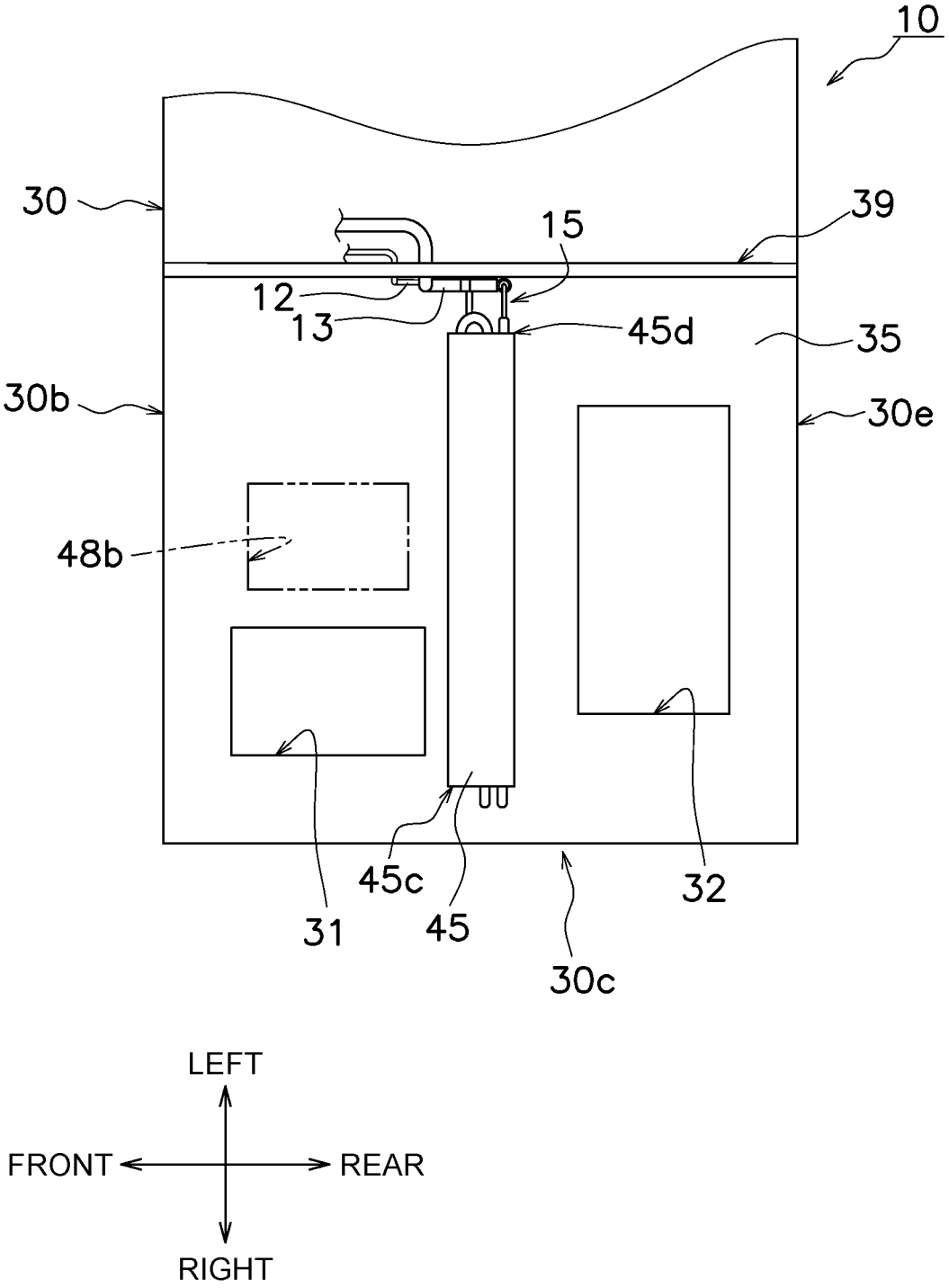
FIG. 12 is an exemplary view for explaining a positional relationship between each member and a first opening and a second opening.

In the utilization-side space SP2, an expansion valve 44, a utilization-side heat exchanger 45, and a utilization-side fan 48 are arranged. For the utilization-side fan 48, for example, a centrifugal fan is used. Examples of the centrifugal fan include, for example, a sirocco fan. Note that the expansion valve 44 may be arranged in the heat-source-side space SP1. As shown in FIG. 5, the utilization-side fan 48 is arranged above the first opening 31 by a support stand 51. As shown in FIG. 12, a blow-out port 48*b* of the utilization-side fan 48 is arranged at a position that does not overlap with the first opening 31 in top view. Since the support stand 51 and the casing 30 surround a portion other than the blow-out port 48*b* and the first opening 31 of the utilization-side fan 48, substantially all of air blown out from the blow-out port 48*b* of the utilization-side fan 48 is supplied into a room from the first opening 31 through the duct 21.

The utilization-side heat exchanger 45 includes a plurality of heat transfer tubes 45*a* (see FIG. 11) through which refrigerant flows, and a plurality of heat transfer fins (not shown) in which air flows through gaps between with each other. The plurality of heat transfer tubes 45*a* are arranged aligned in an up-down direction (a row direction), and each heat transfer tube 45*a* extends in a direction (in the first embodiment, a left-right direction) substantially orthogonal to the up-down direction. Here, the refrigerant flows in the left-right direction in the plurality of heat transfer tubes 45*a*. Further, the plurality of heat transfer tubes 45*a* are provided in a plurality of rows in a front-rear direction. At an end portion of the utilization-side heat exchanger 45, for example, the heat transfer tubes 45*a* are bent in a U shape or connected to each other by a U-shaped tube such that a flow of the refrigerant is folded back from one column to another column and/or from one row to another row. The plurality of heat transfer fins extending long in the up-down direction are arranged along an extending direction of the heat transfer tubes 45*a* at a predetermined distance from each other. Then, the plurality of heat transfer fins and the plurality of heat transfer tubes 45*a* are combined such that the plurality of heat transfer tubes 45*a* penetrate individual heat transfer fins. For example, a copper tube can be used for the heat transfer tube 45*a* included in the utilization-side heat exchanger 45, and aluminum can be used for the heat transfer fin. Further, all of the heat transfer tubes 45*a* and the heat transfer fins included in the utilization-side heat exchanger 45 can be made of, for example, aluminum.

The utilization-side heat exchanger 45 has a shape that is short in the front-rear direction and long in the up-down and left-right directions. A drain pan 52 has such a shape obtained by removing a top surface of a rectangular parallelepiped extending long to the left and right. The drain pan 52 has a dimension, in the front-rear direction, that is longer than a length in the front-rear direction of the utilization-side heat exchanger 45 in top view. The utilization-side heat exchanger 45 is fitted in such a drain pan 52. Then, the drain pan 52 receives dew condensation water generated in the utilization-side heat exchanger 45 and dripping downward. The drain pan 52 extends from the right side surface 30*c* to the partition plate 39 in the casing 30. A drain port 52*a* of the drain pan 52 penetrates the right side surface 30*c* of the casing 30, and the dew condensation water received by the drain pan 52 is drained to the outside of the casing 30 through the drain port 52*a*.

Further, the utilization-side heat exchanger 45 extends from a vicinity of the right side surface 30*c* of the casing 30 to a vicinity of the partition plate 39. A metal plate closes a space between the right side surface 30*c* of the casing 30 and a right side portion 45*c* of the utilization-side heat exchanger 45, and a space between the partition plate 39 and a left side portion 45*d* of the utilization-side heat exchanger 45. The drain pan 52 is supported by a support frame 36 at a position of a height h1 with the bottom plate 35 as a reference, away from the bottom plate 35 upward. The support of the utilization-side heat exchanger 45 includes a rod-shaped frame member that is adapted to a periphery of the top, bottom, left, and right of the utilization-side heat exchanger 45, and is assisted by an auxiliary frame 53 that is directly or indirectly fixed to the casing 30 and the partition plate 39. A space between the utilization-side heat exchanger 45 and the top surface 30*a* of the casing 30 is closed by the utilization-side heat exchanger 45 itself or the auxiliary frame 53. Further, an opening between the utilization-side heat exchanger 45 and the bottom plate 35 is closed by the support stand 51 and the drain pan 52.

In this way, the utilization-side heat exchanger 45 divides the utilization-side space SP2 into a space on an upstream side of the utilization-side heat exchanger 45 and a space on a downstream side of the utilization-side heat exchanger 45. Then, all the air flowing from the upstream side to the downstream side of the utilization-side heat exchanger 45 passes through the utilization-side heat exchanger 45. The utilization-side fan 48 is arranged in the space on the downstream side of the utilization-side heat exchanger 45, and generates an airflow that passes through the utilization-side heat exchanger 45. The support stand 51 described above further divides the space on the downstream side of the utilization-side heat exchanger 45 into a space on a suction side and a space on a blow-out side of the utilization-side fan 48.

(3-4) Refrigerant Circuit

Figure 9:
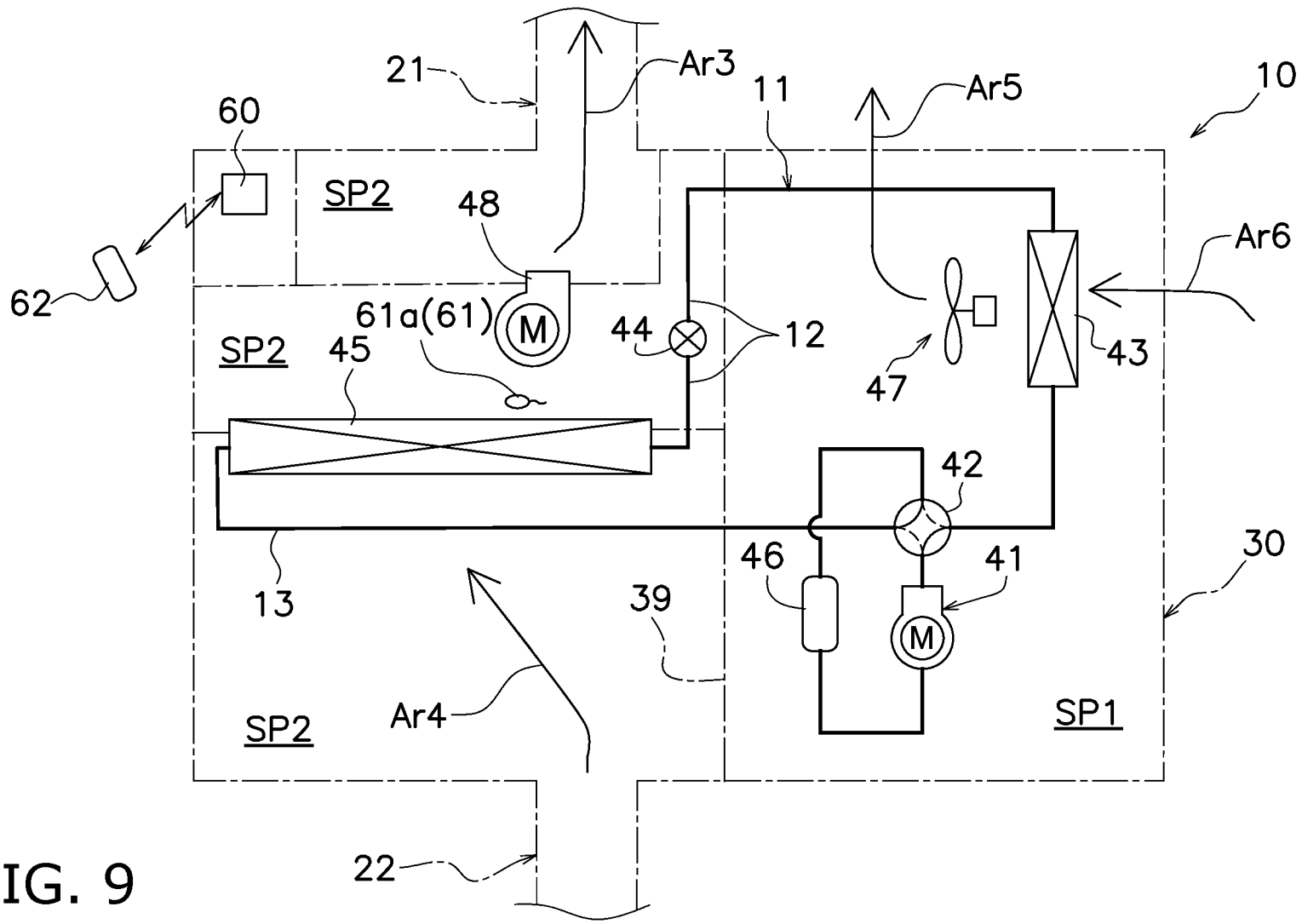
FIG. 9 is a diagram for explaining a refrigerant circuit of the air conditioner according to the first embodiment.

FIG. 9 shows a refrigerant circuit 11 configured in the air conditioner 10. The refrigerant circuit 11 includes the utilization-side heat exchanger 45 and the heat-source-side heat exchanger 43. In the refrigerant circuit 11, refrigerant circulates between the utilization-side heat exchanger 45 and the heat-source-side heat exchanger 43. In this refrigerant circuit 11, when a vapor compression refrigeration cycle is being performed in a cooling operation or a heating operation, heat is exchanged between the utilization-side heat exchanger 45 and the heat-source-side heat exchanger 43. In FIG. 9, an arrow Ar3 indicates supply air, which is an airflow on the downstream side of the utilization-side heat exchanger 45 and blown out from the utilization-side fan 48, while an arrow Ar4 indicates return air, which is an airflow on the upstream side of the utilization-side heat exchanger 45. Further, an arrow Ar5 indicates an airflow blown out from the third opening 33 by the heat-source-side fan 47, which is an airflow on a downstream side of the heat-source-side heat exchanger 43, while an arrow Ar6 indicates an airflow suctioned from the slit 34 by the heat-source-side fan 47, which is an airflow on an upstream side of the heat-source-side heat exchanger 43.

The refrigerant circuit 11 includes the compressor 41, the four-way valve 42, the heat-source-side heat exchanger 43, the expansion valve 44, the utilization-side heat exchanger 45, and the accumulator 46. The four-way valve 42 switches to a connection state shown by a solid line during a cooling operation, and switches to a connection state shown by a broken line during a heating operation.

During the cooling operation, gas refrigerant compressed by the compressor 41 is sent to the heat-source-side heat exchanger 43 through the four-way valve 42. This refrigerant radiates heat to outdoor air with the heat-source-side heat exchanger 43, and is sent to the expansion valve 44 through a refrigerant pipe 12. In the expansion valve 44, the refrigerant expands to be decompressed, and is sent to the utilization-side heat exchanger 45 through the refrigerant pipe 12. The low-temperature and low-pressure refrigerant sent from the expansion valve 44 exchanges heat in the utilization-side heat exchanger 45 to take heat from indoor air. The air removed of heat and cooled by the utilization-side heat exchanger 45 is supplied to the room 210 through the duct 21. Gas refrigerant or gas-liquid two-phase refrigerant that has exchanged heat in the utilization-side heat exchanger 45 is suctioned into the compressor 41 through a refrigerant pipe 13, the four-way valve 42, and the accumulator 46.

During the heating operation, gas refrigerant compressed by the compressor 41 is sent to the utilization-side heat exchanger 45 through the four-way valve 42 and the refrigerant pipe 13. This refrigerant exchanges heat with indoor air in the utilization-side heat exchanger 45 to give heat to the indoor air. The air given with heat and heated by the utilization-side heat exchanger 45 is supplied to the room 210 through the duct 21. The refrigerant that has exchanged heat in the utilization-side heat exchanger 45 is sent to the expansion valve 44 through the refrigerant pipe 12. The low-temperature low-pressure refrigerant expanded by the expansion valve 44 to be decompressed is sent to the heat-source-side heat exchanger 43 through the refrigerant pipe 12, and exchanges heat by the heat-source-side heat exchanger 43 to obtain heat from the outdoor air. Gas refrigerant or gas-liquid two-phase refrigerant that has exchanged heat in the heat-source-side heat exchanger 43 is suctioned into the compressor 41 through the four-way valve 42 and the accumulator 46.

(3-5) Control System

Figure 10:
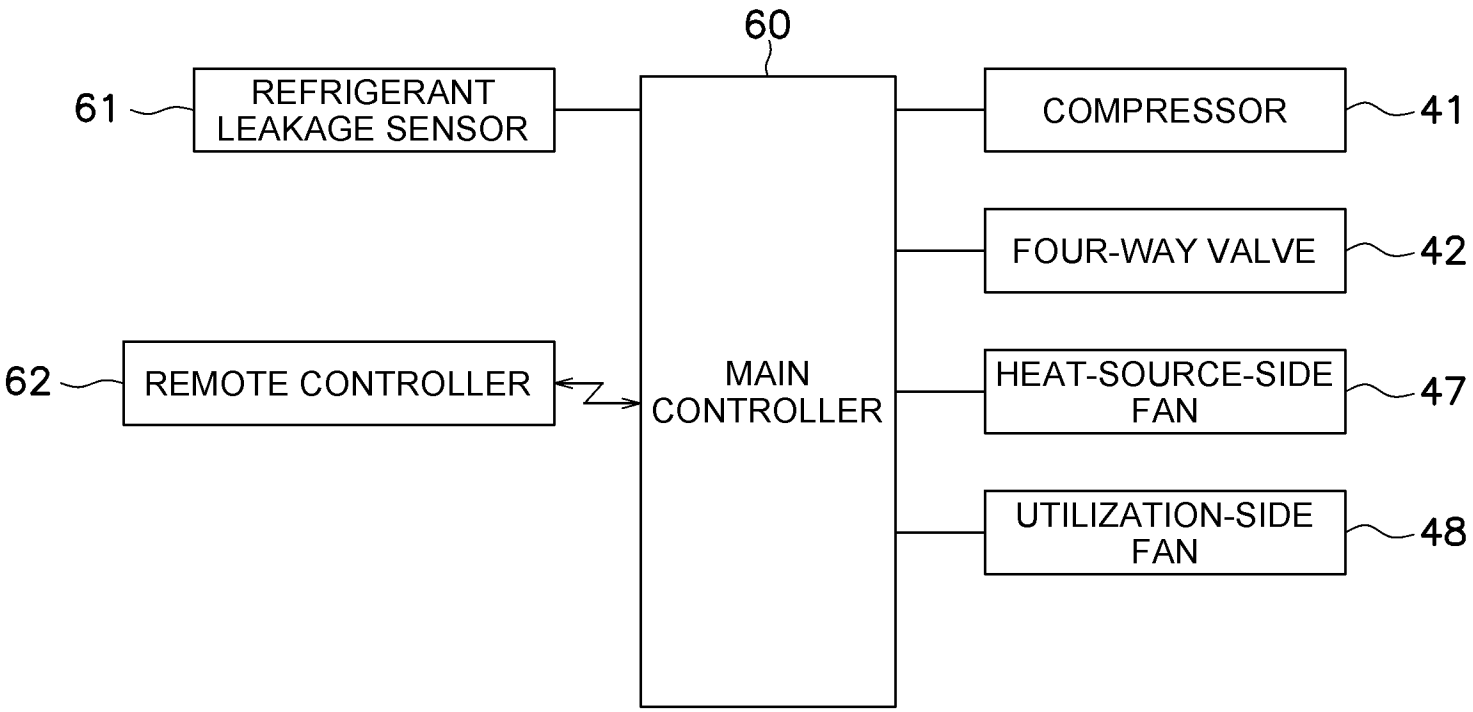
FIG. 10 is a block diagram for explaining a control system of the air conditioner according to the first embodiment.

FIG. 10 shows a main controller 60 that controls the air conditioner 10, main equipment controlled by the main controller 60, and the like. The main controller 60 controls the compressor 41, the four-way valve 42, the heat-source-side fan 47, and the utilization-side fan 48. The main controller 60 is configured to communicate with a remote controller 62. A user can transmit a set value of an indoor temperature of the room 210, and the like, from the remote controller 62 to the main controller 60.

For the control of the air conditioner 10, there are provided a plurality of temperature sensors to measure a refrigerant temperature of each part of the refrigerant circuit 11 and/or pressure sensors to measure a pressure of each part, and temperature sensors to measure an air temperature of each part. However, here, in order to mainly explain the control related to refrigerant leakage, sensors other than a refrigerant leakage sensor 61 used for controlling the air conditioner 10 for normal operation are omitted in FIG. 10.

The main controller 60 controls at least on and off of the compressor 41, on and off of the heat-source-side fan 47, and on and off of the utilization-side fan 48. Note that, in a case where any or all of the compressor 41, the heat-source-side fan 47, and the utilization-side fan 48 have a type of motor that can change a number of revolutions, the main controller 60 may be configured to control a number of revolutions of a motor with variable number of revolutions among the compressor 41, the heat-source-side fan 47, and the utilization-side fan 48. In that case, the main controller 60 can change a circulation amount of refrigerant flowing through the refrigerant circuit 11, by changing a number of revolutions of a motor of the compressor 41. By changing a number of revolutions of a motor of the heat-source-side fan 47, the main controller 60 can change a flow rate of outdoor air flowing between the heat transfer fins of the heat-source-side heat exchanger 43. Further, by changing a number of revolutions of a motor of the utilization-side fan 48, the main controller 60 can change a flow rate of indoor air flowing between the heat transfer fins of the utilization-side heat exchanger 45.

The main controller 60 is connected with the refrigerant leakage sensor 61. When refrigerant gas leaked into air reaches equal to or more than a detection lower limit concentration, the refrigerant leakage sensor 61 transmits a signal indicating detection of refrigerant gas leakage to the main controller 60.

The main controller 60 is realized by, for example, a computer. The computer constituting the main controller 60 includes a control arithmetic device and a storage device. A processor such as a CPU or a GPU can be used as the control arithmetic device. The control arithmetic device reads a program stored in the storage device and performs predetermined image processing and arithmetic processing in accordance with the program. Further, the control arithmetic device can write an arithmetic result to the storage device and read information stored in the storage device in accordance with the program. Alternatively, the main controller 60 may be configured using an integrated circuit (IC) capable of performing control similar to that performed using the CPU and memory. The IC mentioned here includes a large-scale integrated circuit (LSI), an application-specific integrated circuit (ASIC), a gate array, a field programmable gate array (FPGA), and the like.

(3-6) Refrigerant Leakage Sensor 61

Figure 6:
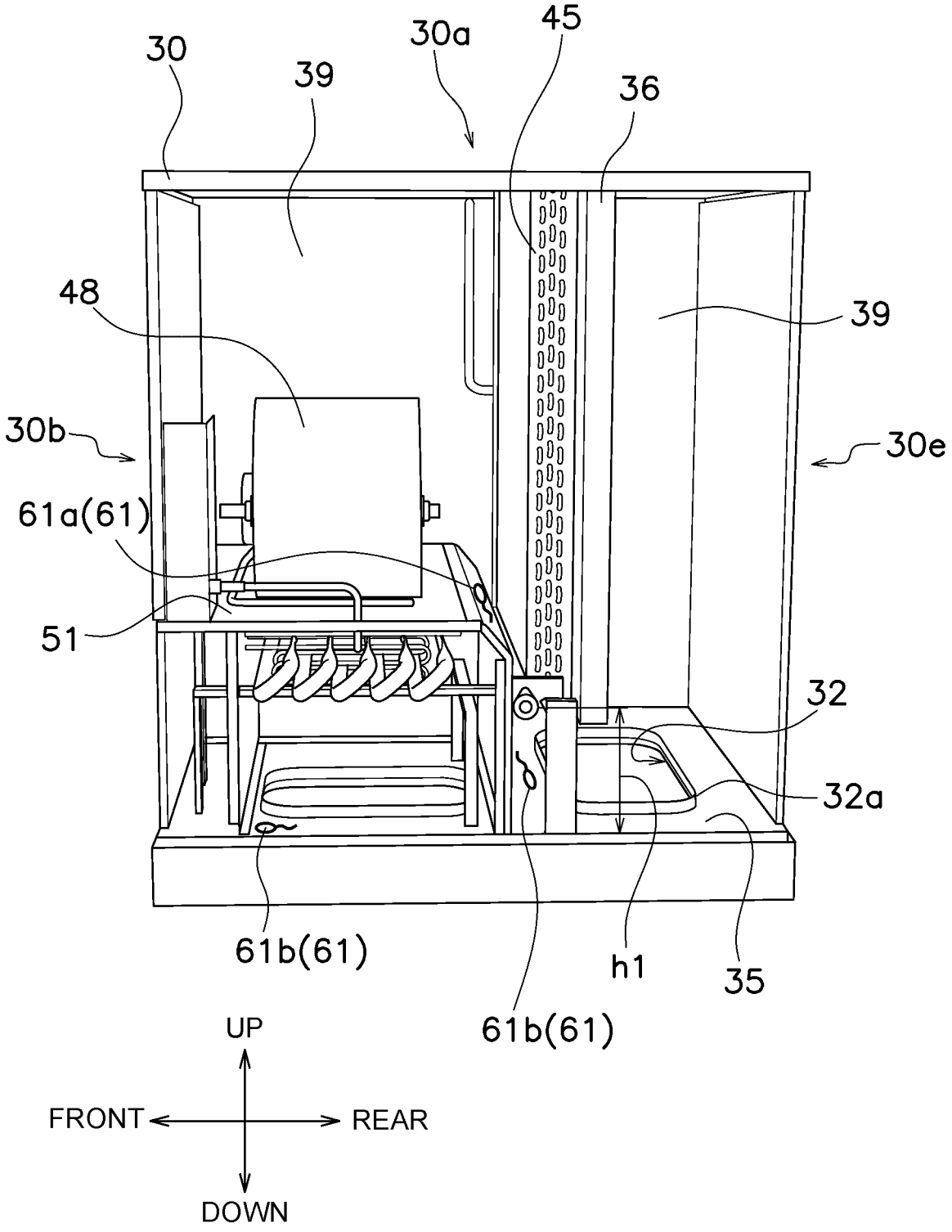
FIG. 6 is a right side view for explaining an internal configuration of the air conditioner.

As shown in FIGS. 6 and 9, the refrigerant leakage sensor 61 may include a first refrigerant leakage sensor 61*a* arranged downstream of the utilization-side heat exchanger 45 in an airflow of indoor air. The first refrigerant leakage sensor 61*a* is arranged in the utilization-side space SP2. While the first refrigerant leakage sensor 61*a* is arranged at a place downstream of the utilization-side heat exchanger 45, arrangement between the utilization-side heat exchanger 45 and a suction port 48*a* of the utilization-side fan 48 is suitable. Further, the refrigerant flowing through the refrigerant circuit 11 is refrigerant with a higher specific gravity than air when vaporized, that is, refrigerant heavier than air when vaporized, such as R32 refrigerant, R410A refrigerant, or carbon dioxide. Since the refrigerant used in the air conditioner 10 has such properties, the first refrigerant leakage sensor 61*a* may be arranged at a lowest possible position in order to detect leaked refrigerant as soon as possible if the refrigerant leaks. As shown in FIG. 6, the first refrigerant leakage sensor 61*a* may be arranged below the suction port 48*a* of the utilization-side fan 48. In particular, the first refrigerant leakage sensor 61*a* may be arranged on a wall 51*a* of the support stand 51 or the drain pan 52.

The refrigerant leakage sensor 61 may include a second refrigerant leakage sensor 61*b* arranged at a lowermost portion of the utilization-side space SP2. The second refrigerant leakage sensor 61*b* may be installed on either or both of the upstream side and the downstream side of the utilization-side heat exchanger 45. FIG. 6 shows a case where two second refrigerant leakage sensors 61*b* are arranged on both the upstream side and the downstream side of the utilization-side heat exchanger 45. Further, both the first refrigerant leakage sensor 61*a* and the second refrigerant leakage sensor 61*b* may be simultaneously installed. The second refrigerant leakage sensor 61*b* shown in FIG. 6 is arranged so as to be in contact with the bottom plate 35, which is a lowermost portion of the utilization-side space SP2.

Figure 11:
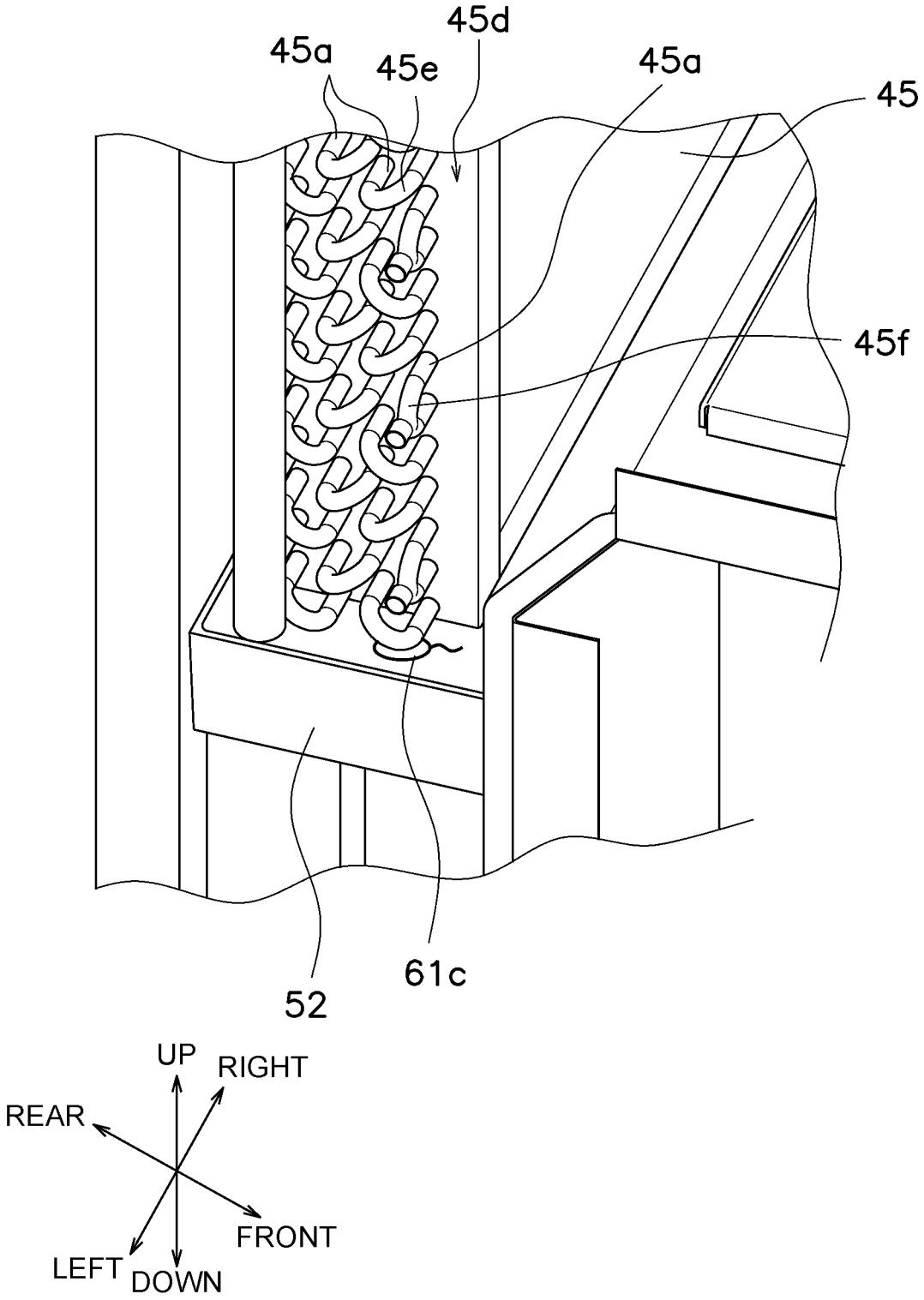
FIG. 11 is a partially enlarged perspective view of a periphery of a left side portion of a utilization-side heat exchanger.

FIG. 11 shows a part of a structure around the left side portion 45*d* of the utilization-side heat exchanger 45 near the partition plate 39 in an enlarged manner. The refrigerant leakage sensor 61 may include a third refrigerant leakage sensor 61*c* arranged below a brazed part of a refrigerant pipe in the utilization-side space SP2. A U-shaped refrigerant pipe 45*e* shown in FIG. 11 reverses a direction of a flow of the refrigerant flowing through the heat transfer tube 45*a* of the utilization-side heat exchanger 45 by 180 degrees. The heat transfer tube 45*a* arranged so as to extend in a left-right direction in the utilization-side heat exchanger 45 is also a type of refrigerant pipe. The U-shaped refrigerant pipe 45*e* and the heat transfer tube 45*a* are brazed. This brazed part is also a connection part 15 (see FIG. 12). In addition, some of the heat transfer tubes 45*a* are connected to a Y-shaped refrigerant pipe 45*f*. The Y-shaped refrigerant pipe 45*f* is used to split or merge refrigerants flowing through the two heat transfer tubes 45*a*. The heat transfer tube 45*a* and the refrigerant pipe 45*f* are also brazed. The third refrigerant leakage sensor 61*c* is arranged below the brazed parts of the heat transfer tubes 45*a* and the refrigerant pipes 45*e* and 45*f*, which are the refrigerant pipes. The third refrigerant leakage sensor 61*c* is arranged at a position enabling quick detection of refrigerant leaking from the brazed part and falling down when the brazed part is damaged. The brazed part of the refrigerant pipe in the utilization-side space SP2 is not limited to the brazed part of the heat transfer tube 45*a* described above, and the number of the third refrigerant leakage sensors 61*c* is not limited to one. Further, the third refrigerant leakage sensor 61*c* may be arranged below the brazed part of the refrigerant pipes 12 and 13.

As shown in FIG. 12, the connection part 15 is arranged at a position that does not overlap with the first opening 31 and the second opening 32 in top view. The first embodiment has shown a case where the connection part 15 is arranged near the left side portion 45*d* of the utilization-side heat exchanger 45. However, even if the connection part 15 is arranged near the right side portion 45*c* of the utilization-side heat exchanger 45, the connection part 15 can be arranged at a position that does not overlap with the first opening 31 and the second opening 32 in top view.

Since the heat transfer tube 45*a* of the utilization-side heat exchanger 45 may corrode and the refrigerant may leak from the heat transfer tube 45*a*, the heat transfer tube 45*a* of the utilization-side heat exchanger 45 and the first opening 31 and the second opening 32 are arranged so as not to overlap with each other in top view. Further, the refrigerant pipes 12, 13, 45*e*, and 45*f* are also arranged so as not to overlap with the first opening 31 and the second opening 32 in top view.

(4) Modified Examples

(4-1) Modified Example 1A

In the first embodiment, the utilization-side heat exchanger 45 is arranged so as to extend long in the left-right direction. However, without limiting to such an arrangement, the utilization-side heat exchanger 45 may be arranged so as to extend long in a front-rear direction, for example.

(4-2) Modified Example 1B

Figure 14:
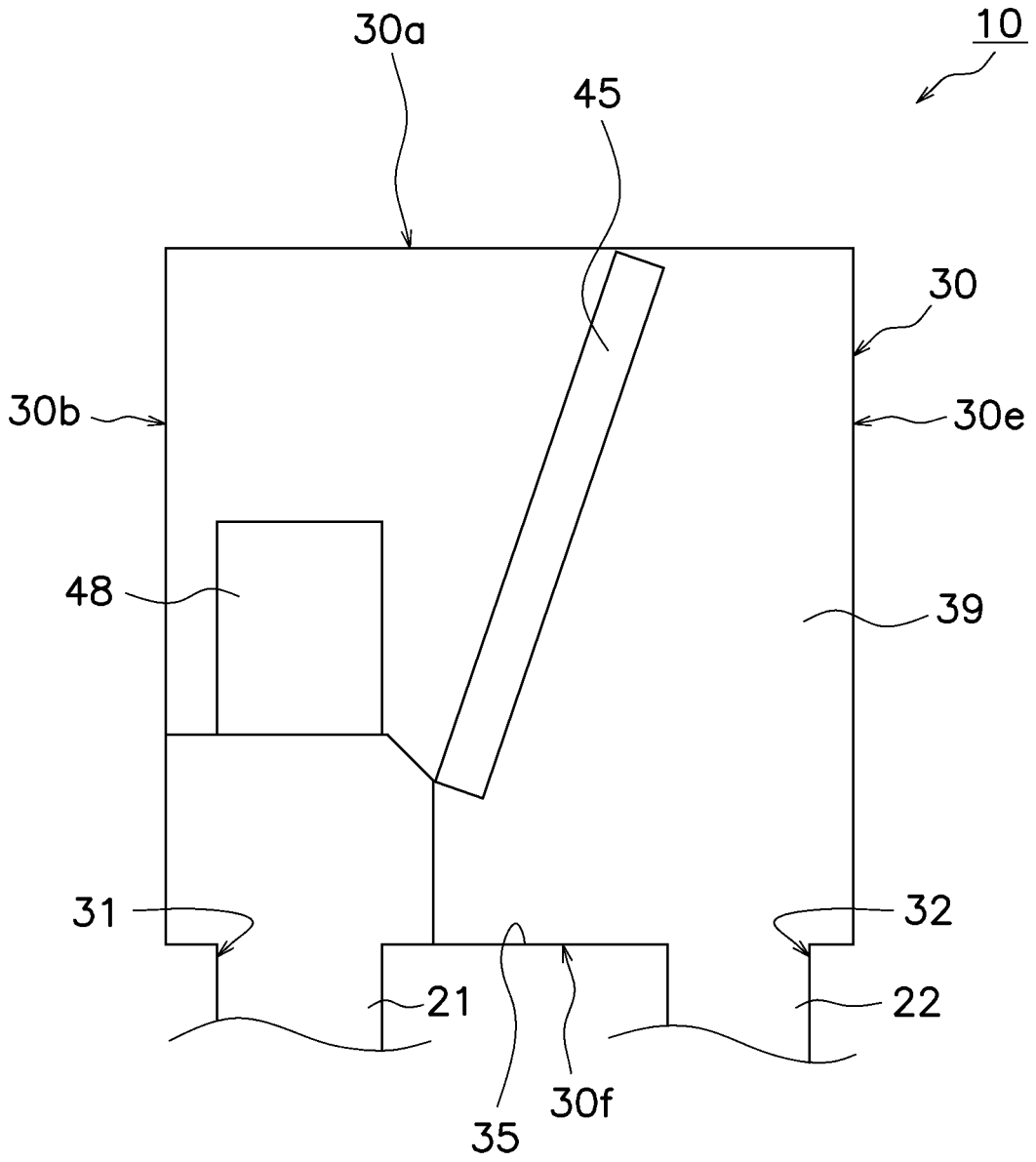
FIG. 14 is an exemplary view for explaining a positional relationship between each member and a first opening and a second opening according to Modified example 1B.
Figure 15:
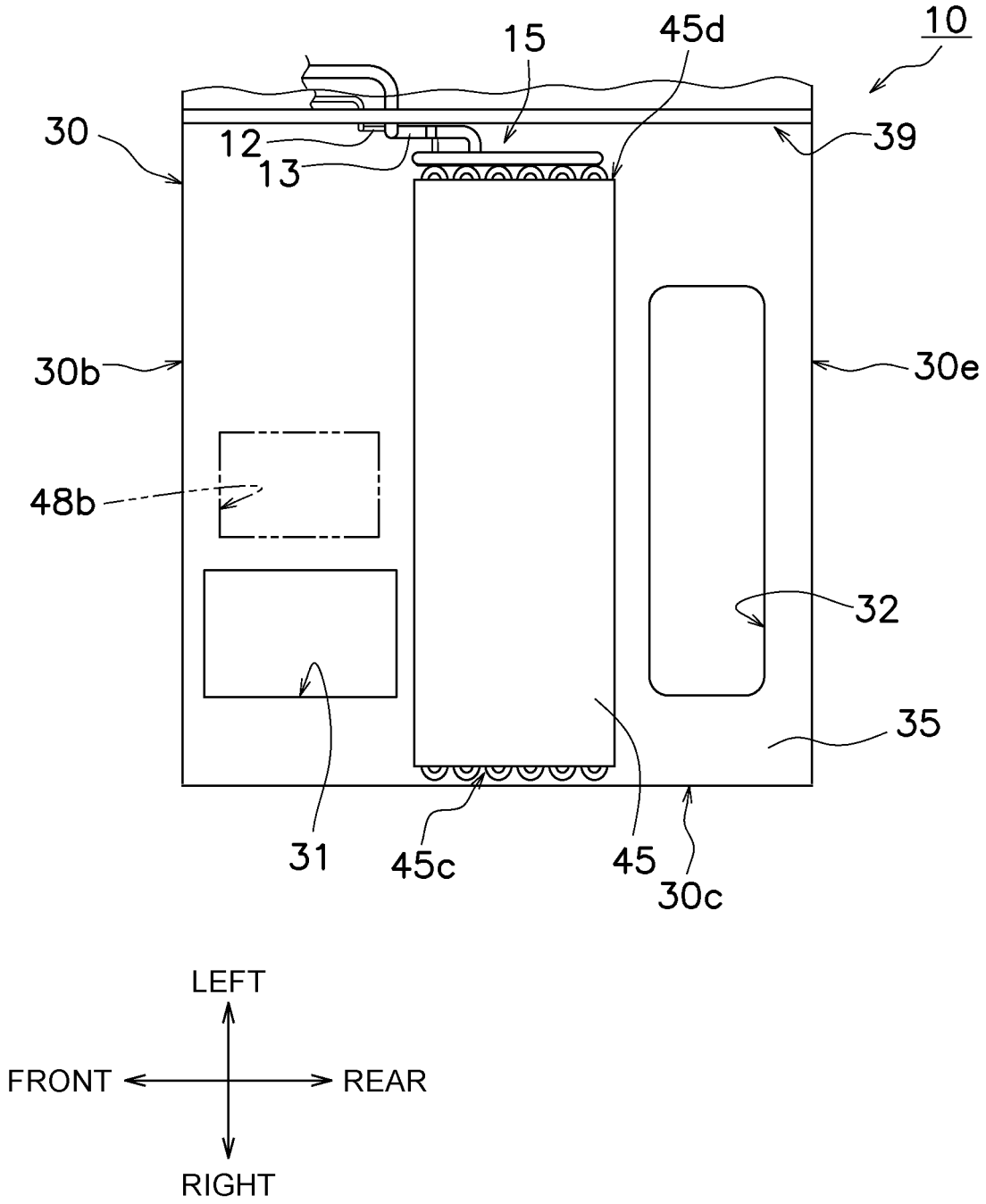
FIG. 15 is an exemplary view for explaining a positional relationship between each member and the first opening and the second opening according to Modified example 1B.

In the first embodiment, the description has been given to a case where the right side portion 45*c* and a left side portion 45*b* of the utilization-side heat exchanger 45 are standing perpendicularly to the bottom plate 35, in other words, perpendicularly to a horizontal plane. However, as shown in FIGS. 14 and 15, the right side portion 45*c* and the left side portion 45*b* of the utilization-side heat exchanger 45 may be installed to be inclined with respect to the bottom plate 35, in other words, to be inclined with respect to the horizontal plane. Even when the utilization-side heat exchanger 45 is arranged to be inclined in this way, as shown in FIGS. 14 and 15, the connection part 15, the heat transfer tube 45*a* of the utilization-side heat exchanger 45, and the refrigerant pipes 12, 13, 45*e*, and 45*f* are also arranged so as not to overlap with the first opening 31 and the second opening 32 in top view.

(4-3) Modified Example 1C

Figure 13:
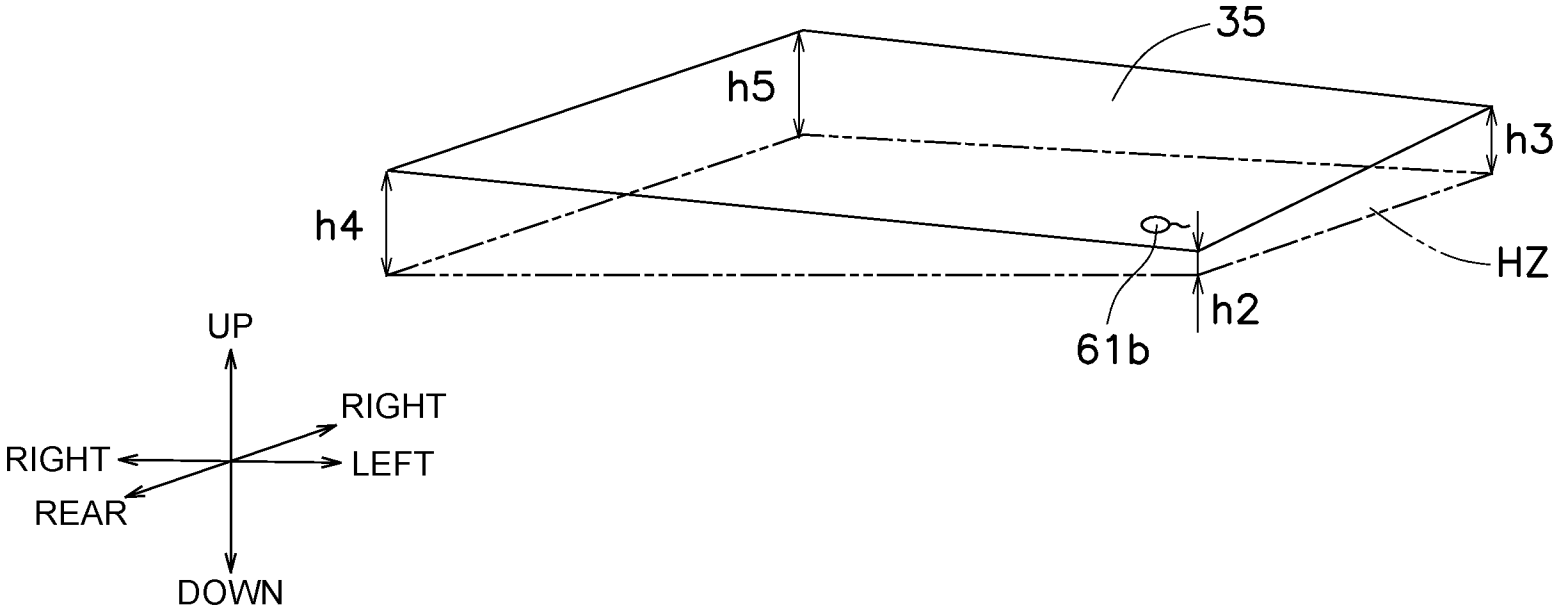
FIG. 13 is a perspective view for explaining a bottom plate 35 according to Modified example 1C.

In the first embodiment, the bottom plate 35 is arranged horizontally, and the second refrigerant leakage sensor 61*b* will be arranged at the lowermost portion of the utilization-side space SP2 when being installed anywhere on the bottom plate 35. However, the bottom plate 35 does not necessarily need to be installed horizontally, and the bottom plate 35 may be tilted with respect to a horizontal plane HZ, for example, as shown in FIG. 13. When heights of four corners of the bottom plate 35 are h2, h3, h4, and h5, and h2<h3<h4<h5 is satisfied, for example, the second refrigerant leakage sensor 61*b* may be arranged at the corner of the lowest height h2. When the corner having the height h2 is on a left rear side of the utilization-side space SP2, the second refrigerant leakage sensor 61*b* is arranged in contact with a left rear portion of the utilization-side space SP2 of the bottom plate 35. Further, the bottom plate 35 need not be flat but may be curved. When the bottom plate 35 is curved, the second refrigerant leakage sensor 61*b* is arranged near a lowest point of the bottom plate 35.

(5) Characteristics 5-1

Since the air conditioner 10 according to the first embodiment includes the refrigerant leakage sensor 61, it is possible to detect that refrigerant has leaked in the utilization-side space SP2, for example, to take measures against refrigerant leakage as soon as possible, such as measures to prevent the leaked refrigerant from flowing into the room through the ducts 21 and 22, or measures to warn that the refrigerant has leaked.

5-2

In the air conditioner 10 according to the first embodiment, the first refrigerant leakage sensor 61*a* is arranged downstream of the utilization-side heat exchanger 45 in an airflow of indoor air. Therefore, when there is an airflow passing through the utilization-side heat exchanger 45, leakage of the refrigerant can be detected quickly when the refrigerant leaks around the utilization-side heat exchanger 45, as compared to a case where the refrigerant leakage sensor 61 is arranged upstream of the utilization-side heat exchanger 45.

5-3

In the air conditioner 10 according to the first embodiment, the second refrigerant leakage sensor 61*b* is arranged at the lowermost portion of the utilization-side space SP2. Therefore, when the refrigerant leaks in the utilization-side space SP2, the leakage of the refrigerant can be detected at an early stage before the refrigerant fills the utilization-side space SP2.

5-4

In the air conditioner 10 according to the first embodiment, when both the first refrigerant leakage sensor 61*a* and the second refrigerant leakage sensor 61*b* are provided, leakage of the refrigerant can be quickly detected when the refrigerant leaks around the utilization-side heat exchanger 45 during operation, and leakage of the refrigerant can be detected at an early stage before the refrigerant fills the utilization-side space SP2 when the refrigerant leaks in the utilization-side space SP2 while the operation is stopped.

5-5

In the air conditioner 10 according to the first embodiment, since the third refrigerant leakage sensor 61*c* is arranged below the brazed part in the utilization-side space SP2, leakage of the refrigerant can be detected as soon as possible when the brazed part is damaged and then the refrigerant leaks from the brazed part.

5-6

In the air conditioner 10 according to the first embodiment, as shown in FIG. 12, the connection part 15 is arranged at a position that does not overlap with the first opening 31 and the second opening 32 in top view. Therefore, it is possible to prevent a direct flow of refrigerant leaking from the connection part 15, into the first opening 31 and the second opening 32. As a result, if refrigerant leaks at the connection part 15, it is possible to prevent entering of the refrigerant into the room 210 through the first opening 31 and the second opening 32 and the ducts 21 and 22.

As shown in FIGS. 14 and 15, even when the utilization-side heat exchanger 45 is arranged to be inclined, effects similar to those described with reference to FIG. 12 can be obtained, by arranging the connection part 15 at a position that does not overlap with the first opening 31 and the second opening 32.

5-7

In the air conditioner 10 according to the first embodiment, as shown in FIG. 12, the refrigerant pipes 12, 13, 45*e*, and 45*f* and the heat transfer tube 45*a* of the utilization-side heat exchanger 45, which is a refrigerant pipe, are arranged at positions that do not overlap with the first opening 31 and the second opening 32 in top view. Therefore, it is possible to prevent a direct flow, into the first opening 31 and the second opening 32, of the refrigerant leaking from the heat transfer tube 45*a* of the utilization-side heat exchanger 45 or the refrigerant pipes 12, 13, 45*e*, or 45*f*. As a result, when the refrigerant leaks in the heat transfer tube 45*a* of the utilization-side heat exchanger 45 or the refrigerant pipes 12, 13, 45*e*, or 45*f*, it is possible to prevent entering of the refrigerant into the room 210 through the first opening 31 and the second opening 32 and the ducts 21 and 22.

As shown in FIGS. 14 and 15, even when the utilization-side heat exchanger 45 is arranged to be inclined, effects similar to those described with reference to FIG. 12 are obtained by arranging the refrigerant pipes 12, 13, 45*e*, and 45*f* and the heat transfer tube 45*a* of the utilization-side heat exchanger 45, which is a refrigerant pipe, at positions that do not overlap with the first opening 31 and the second opening 32 in top view.

Second Embodiment

(6) Detailed Configuration

Figure 16:
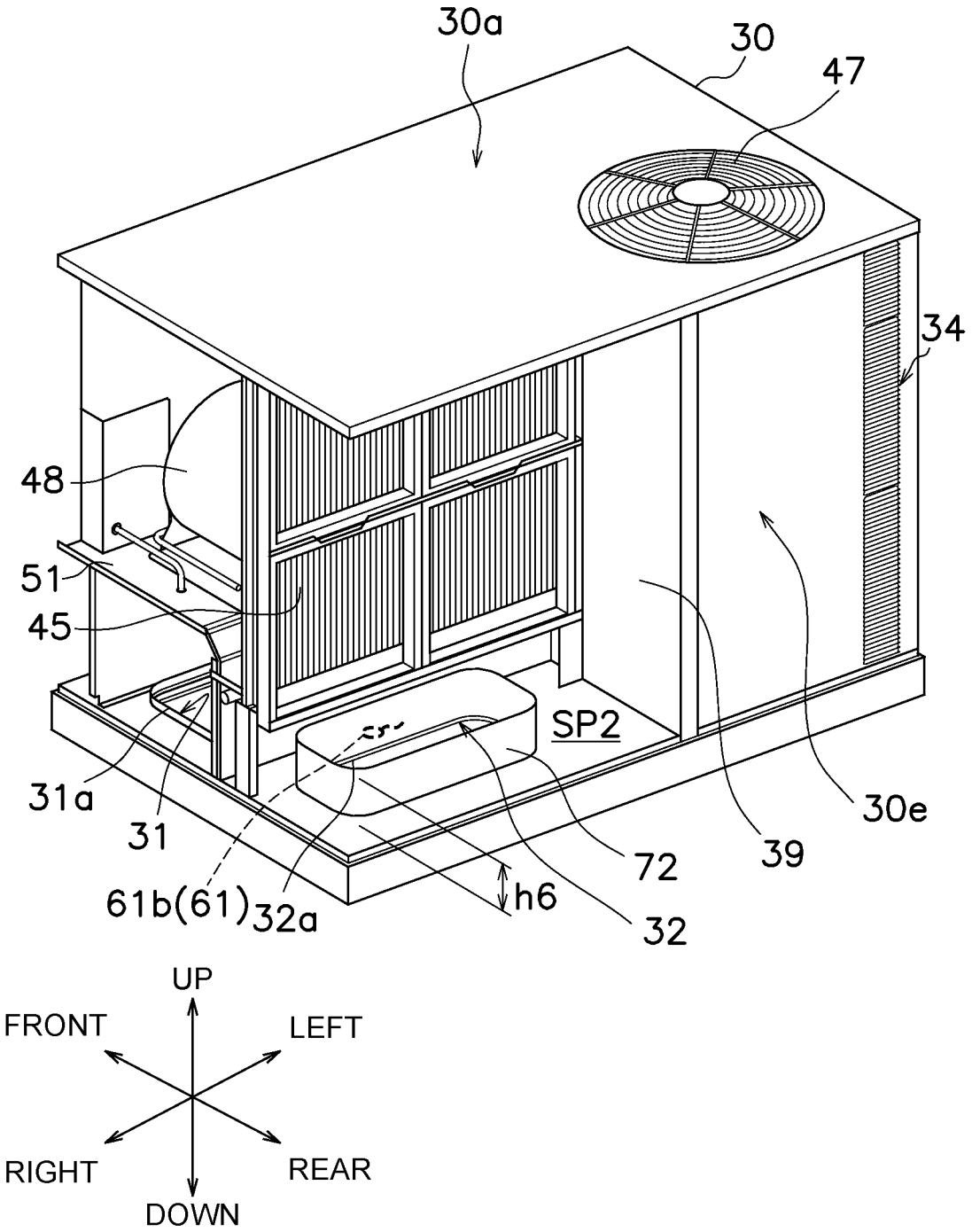
FIG. 16 is a perspective view for explaining an internal configuration of an air conditioner according to a second embodiment.

FIG. 16 shows a part of an internal structure of an air conditioner 10 according to a second embodiment. This FIG. 16 shows, similarly to FIG. 5, a state in a casing 30 where a metal plate that has been covering a right side surface 30*c* and a part of a metal plate that has been covering a back surface 30*e* are removed. As can be clearly seen by comparing the internal structure of the air conditioner 10 according to the second embodiment shown in FIG. 16 and the internal structure of the air conditioner 10 according to the first embodiment shown in FIG. 5, the air conditioner 10 according to the second embodiment is provided with a standing part 72 at a periphery of a second opening 32. The standing part 72 surrounds an entire periphery of the second opening 32. The standing part 72 has a height of 3 cm or higher. Note that a structural difference between the air conditioner 10 according to the second embodiment and the air conditioner 10 according to the first embodiment is whether or not the standing part 72 is provided. Therefore, a description of a configuration other than the standing part 72 of the air conditioner 10 according to the second embodiment will be omitted. Further, a case where the standing part 72 is provided only in the second opening 32 will be described here, but the standing part may be provided in both a first opening 31 and the second opening 32, or the standing part may be provided only in the first opening 31.

The standing part 72 serves as a bank that prevents refrigerant from entering a duct 22 through the second opening 32, when the refrigerant accumulates on a bottom plate 35 due to refrigerant leakage that has occurred in a utilization-side space SP2. Therefore, as the standing part 72 is higher, the effect of preventing the refrigerant from entering the duct 22 becomes higher. However, if the standing part 72 becomes too high, the standing part 72 acts as an air-blowing resistance against an airflow generated by a utilization-side fan 48. This causes a case of reducing an amount of air passing through a part of a utilization-side heat exchanger 45, as compared with others, to deteriorate the performance of the utilization-side heat exchanger 45. Therefore, a dimension from the bottom plate 35 to a height position of an upper end of the standing part 72 may be adapted to reach a vicinity of a height position of a lower end of the utilization-side heat exchanger 45. Here, the fact that the dimension from the bottom plate 35 to the height position of the upper end of the standing part 72 reaches the vicinity of the height position of the lower end of the utilization-side heat exchanger 45 means that the dimension from the bottom plate 35 to the height position of the upper end of the standing part 72 is 80% or more of a dimension from the bottom plate 35 to the height position of the lower end of the utilization-side heat exchanger 45. Note that, a height h6 of the standing part 72 may be substantially a height h1 of a drain pan 52, which is a height of the lower end of the utilization-side heat exchanger 45.

Further, from the viewpoint of accumulating leaked refrigerant, the standing part 72 may have a height equal to or greater than a value obtained by dividing a refrigerant amount of a refrigerant circulating in a heat-source-side heat exchanger 43 and the utilization-side heat exchanger 45, by an area of a place where the refrigerant stays and accumulates. For example, in order to calculate the area of the place where the refrigerant stays and accumulates, an area of the second opening 32 is subtracted from an area of the bottom plate 35 of the utilization-side space SP2 since the refrigerant does not stay in the second opening 32. In this way, an area remaining after subtracting the area of the portion where the refrigerant cannot stay is to be the area of the place where the refrigerant stays and accumulates. The refrigerant amount of the refrigerant circulating in the heat-source-side heat exchanger 43 and the utilization-side heat exchanger 45 is, most simply, a refrigerant amount of the refrigerant in the refrigerant circuit 11. However, for example, when an in and out port of an accumulator 46 is configured to be blocked to inhibit external leakage of the refrigerant of the accumulator 46 when the refrigerant leaks, the refrigerant amount of the refrigerant circulating in the heat-source-side heat exchanger 43 and the utilization-side heat exchanger 45 is to be a value obtained by subtracting a refrigerant amount confined in the accumulator 46 from the refrigerant amount in the refrigerant circuit 11. The refrigerant that leaks and enters the building through ducts 21 and 22 is the refrigerant that leaks into the utilization-side space SP2. Therefore, it can be also said that the height of the standing part 72 may be equal to or greater than a value obtained by dividing an amount of refrigerant that may leak into the utilization-side space SP2 by the area of the place where the refrigerant stays and accumulates. In addition, an additional place where the refrigerant stays and accumulates may be provided so as to communicate with the utilization-side space SP2. In that case, the area of the place where the refrigerant stays and accumulates may be calculated by adding an area of the additional place.

As shown in FIG. 16, when the height of the standing part 72 increases, it becomes difficult to process a metal plate for forming the bottom plate 35 to mold integrally with the bottom plate 35 by press molding, such as ribs 31*a* and 32*a*. Therefore, the standing part 72 is made of a material different from that of the bottom plate 35. For example, the standing part 72 is formed by processing resin or sheet metal into a ring shape. The standing part 72 is, for example, fitted into the rib 32*a*, and is fixed to the bottom plate 35 by a fixing means such as a screw or an adhesive.

(7) Modified Examples

(7-1) Modified Example 2A

Figure 17:
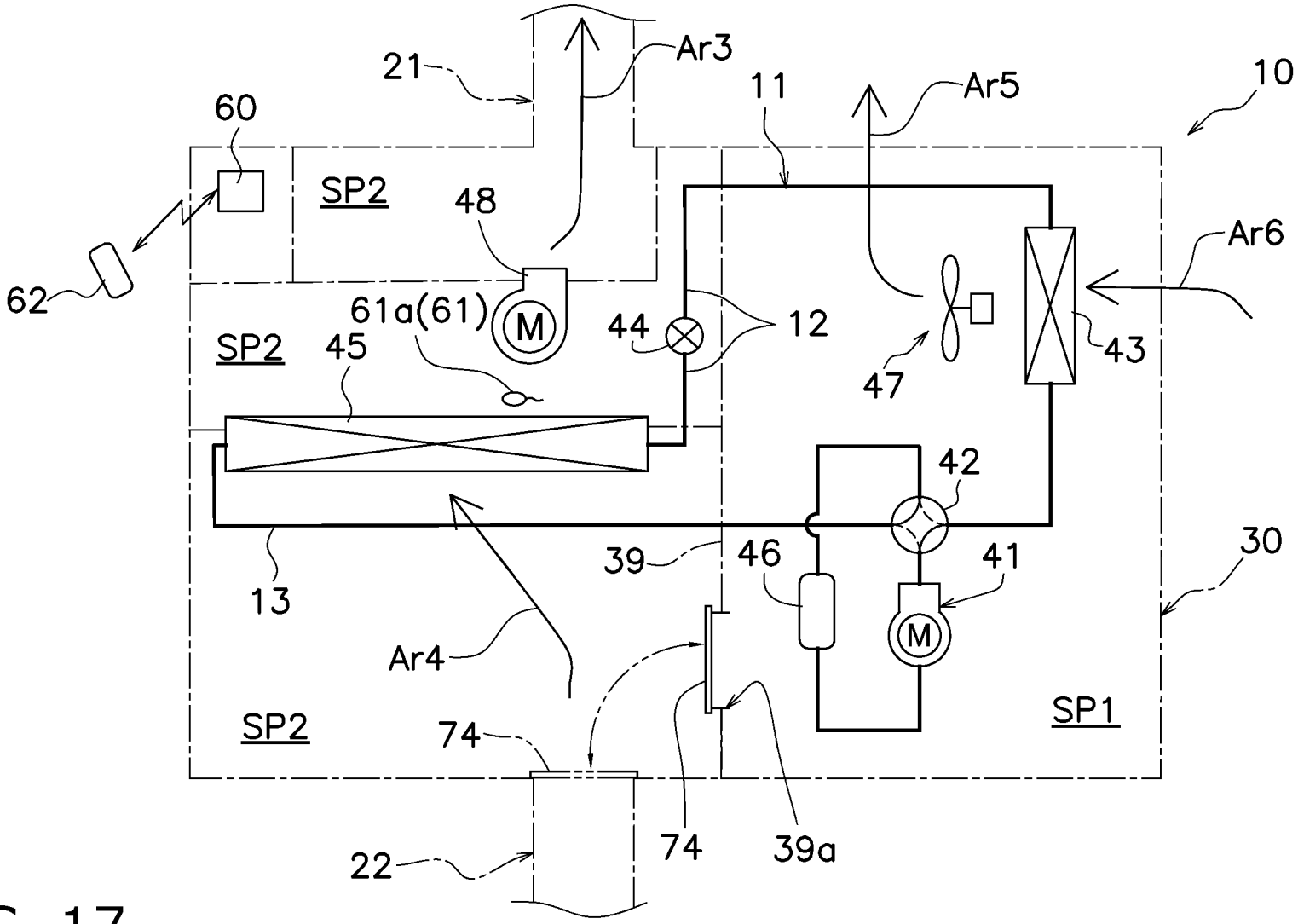
FIG. 17 is a diagram for explaining a refrigerant circuit of the air conditioner according to the second embodiment.
Figure 18:
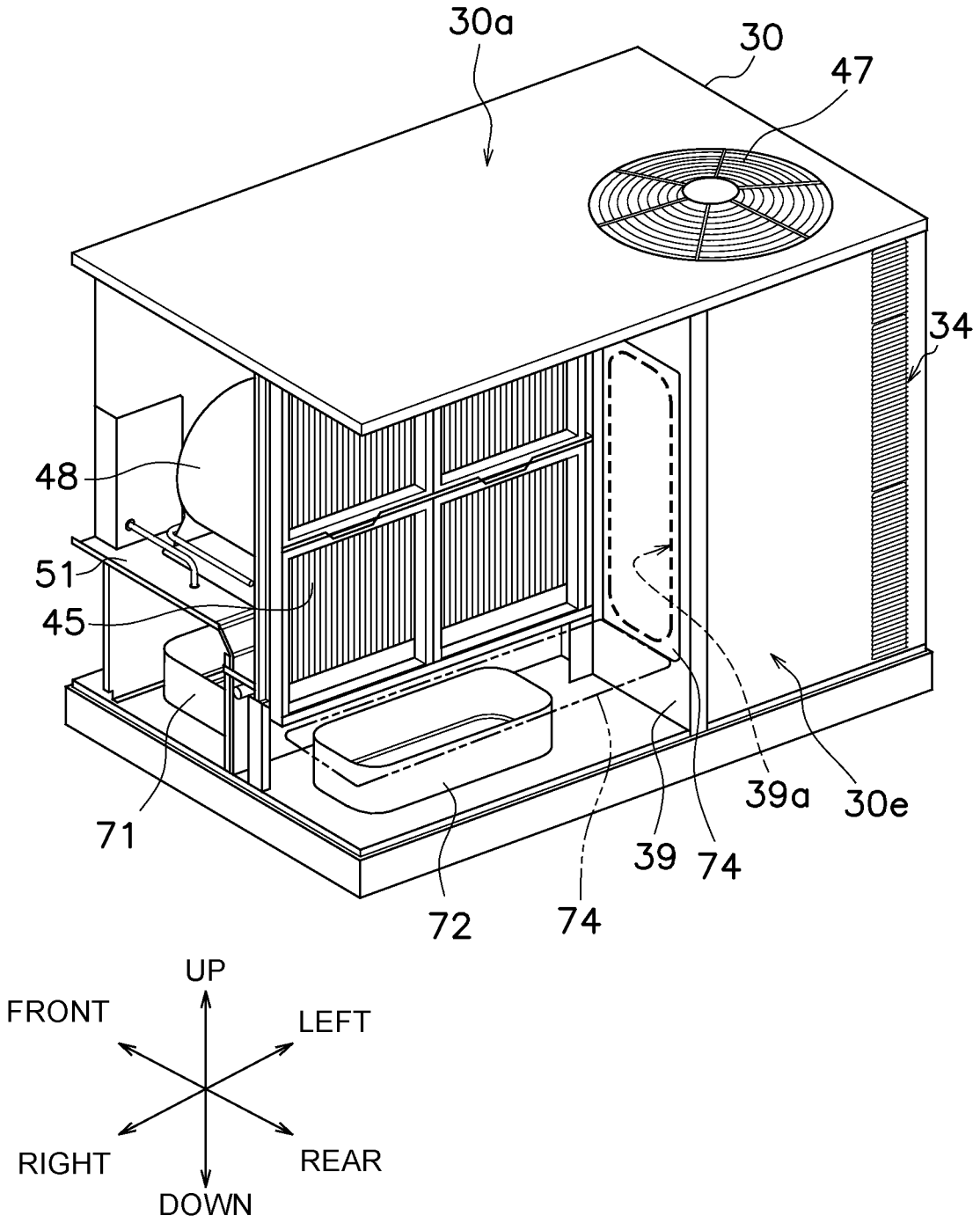
FIG. 18 is a perspective view for explaining an internal configuration of an air conditioner according to Modified example 2A.

In the second embodiment, the standing part 72 merely blocks the leaked refrigerant from entering the duct 22. However, a closing means may be provided to close the duct 22 so that the leaked refrigerant does not enter the duct 22, when refrigerant leakage is detected by the refrigerant leakage sensor 61. Along with this closing means, there may be provided an opening means to connect the utilization-side space SP2 with outside of the casing 30 when refrigerant leakage is detected by the refrigerant leakage sensor 61. The closing means and the opening means can be configured by, for example, a damper whose opening and closing is controlled by the main controller 60. FIGS. 17 and 18 show a damper 74 that closes the duct 22 and connects the utilization-side space SP2 with the outside of the casing 30 when refrigerant leakage is detected by the refrigerant leakage sensor 61.

Figure 19:
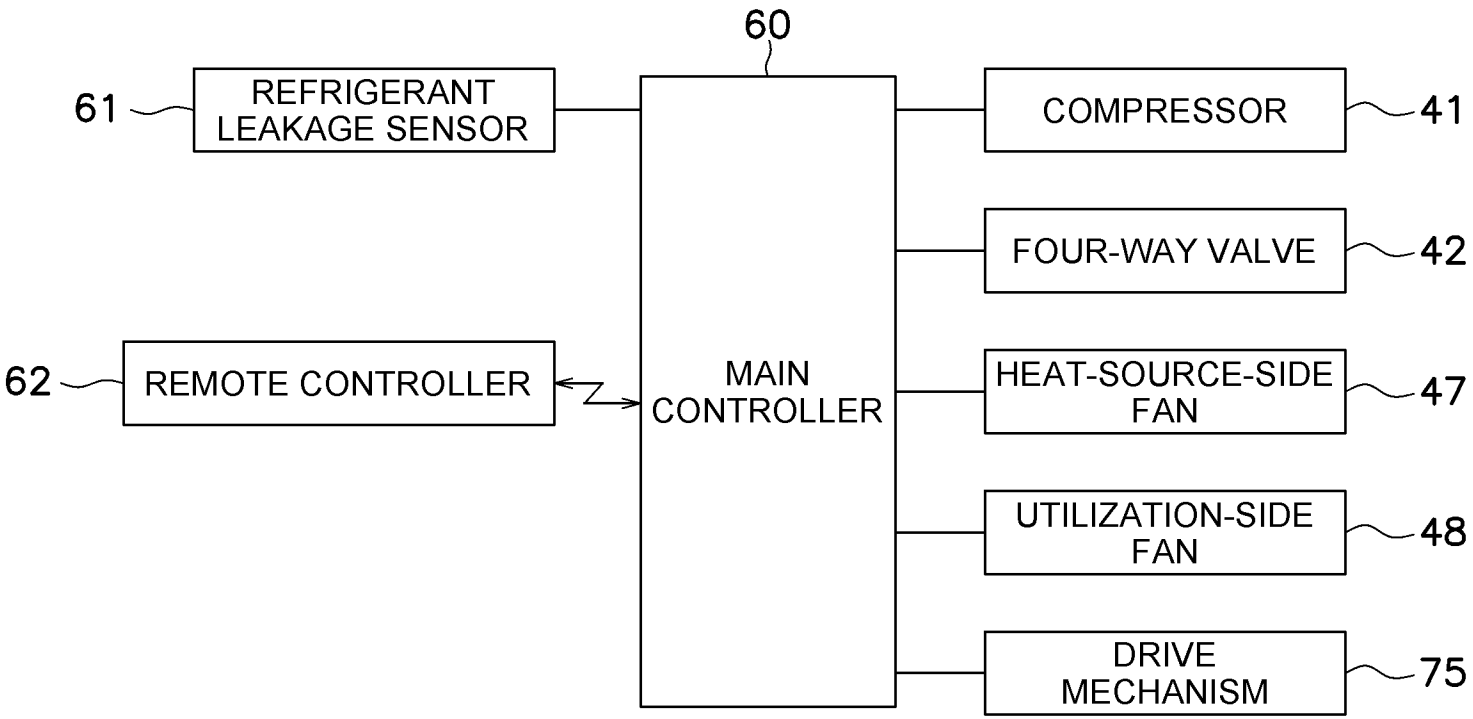
FIG. 19 is a block diagram for explaining a control system of an air conditioner according to Modified example 2A.

The damper 74 closes an opening 39*a* of a partition plate 39 as shown by a solid line in FIG. 18, in a state where refrigerant leakage is not detected by the refrigerant leakage sensor 61. Then, when refrigerant leakage is detected by the refrigerant leakage sensor 61, the damper 74 opens the opening 39*a* of the partition plate 39 and closes the second opening 32, as shown by a two-point difference line in FIG. 18. This damper 74 is provided with a drive mechanism for movement from a state shown by the solid line in FIG. 18 to a state shown by the two-point difference line in FIG. 18. The drive mechanism to drive the damper 74 can include, for example, a motor and a gear controlled by the main controller 60, or an electric latch and a spring. FIG. 19 shows a configuration in which a drive mechanism 75 is controlled by the main controller 60. Note that the air conditioner 10 shown in FIG. 18 is provided with a standing part 71 that surrounds a periphery of the first opening 31.

(7-2) Modified Example 2B

Figure 20:
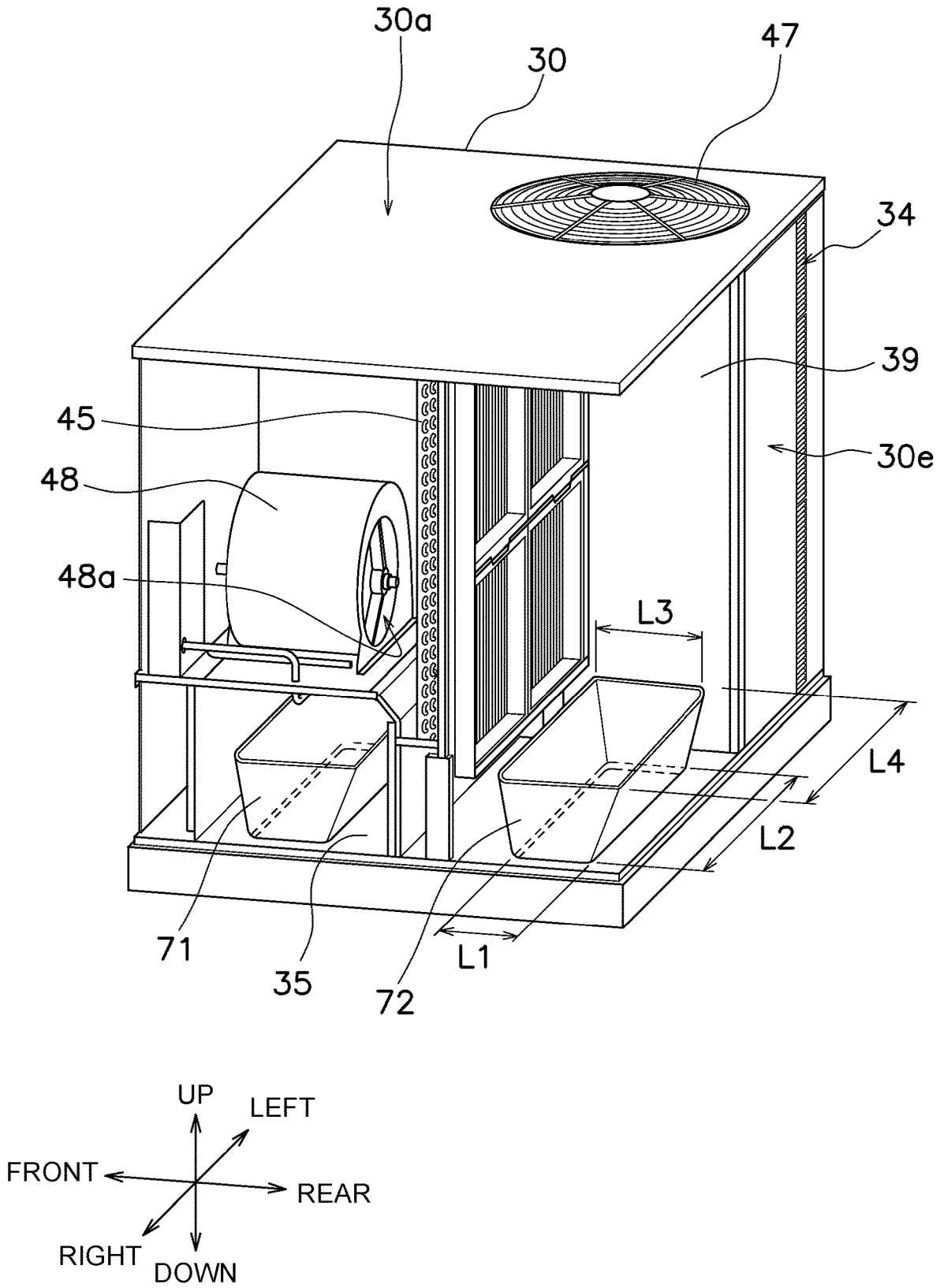
FIG. 20 is a perspective view for explaining an internal configuration of an air conditioner according to Modified example 2B.

In the second embodiment, the configuration in which the standing part 72 rises perpendicularly to the bottom plate 35 has been described. However, the standing part 72 may be configured to have a shape expanding upward like a funnel, for example, as shown in FIG. 20. In order for the standing part 72 to have a shape expanding upward, for example, a horizontal length L3 of an upper part in a front-rear direction may be made larger than a horizontal length L1 of a lower part of the standing part 72 in the front-rear direction. Alternatively, a horizontal length L4 of the upper part in a left-right direction may be made larger than a horizontal length L2 of the lower part of the standing part 72 in the left-right direction. The standing part 72 having such a complicated shape may be formed of resin. Further, as shown in FIG. 20, the standing part 71 may be configured to have a shape expanding upward.

(8) Characteristics 8-1

The air conditioner 10 according to the second embodiment includes: the casing 30 having the partition plate 39 that separates the heat-source-side space SP1 through which outdoor air passes and the utilization-side space SP2 through which indoor air passes, to block a flow of air between the heat-source-side space SP1 and the utilization-side space SP2, and having the bottom plate 35 that has the first opening 31 for supply air and the second opening 32 for return air that communicate with the utilization-side space SP2, and that closes a bottom surface of the utilization-side space SP2. Further, the air conditioner 10 of the second embodiment includes at least one of the standing part 71 surrounding the periphery of the first opening 31 or the standing part 72 surrounding the periphery of the second opening 32. By the standing part 71 and 72 interfering with a flow of leaked refrigerant toward the first opening 31 and the second opening 32 surrounded by the standing part 71 and 72, it is possible to prevent the leaked refrigerant from entering the room 210, which is an indoor air conditioning target space, through the ducts 21 and 22. Note that the duct 21 is a first duct extending from the indoor air conditioning target space to be connected to the first opening 31, and the duct 22 is a second duct extending from the indoor air conditioning target space to be connected to the second opening 32.

8-2

In a case where the operation of the air conditioner 10 according to the second embodiment is stopped and the refrigerant gradually accumulates on the bottom plate 35, when the standing part 72 shown in FIG. 16 has a height equal to or greater than a value obtained by dividing a refrigerant amount of the refrigerant by an area of a place where the refrigerant stays and accumulates, it is possible to prevent the leaked refrigerant from flowing into the second opening 32 over the standing part 72.

8-3

In the air conditioner 10 according to the second embodiment, the partition plate 39 has the damper 74 to connect the heat-source-side space SP1 with the utilization-side space SP2. Therefore, it is possible to suppress flowing of the leaked refrigerant into the second opening 32 over the standing part 72, by the damper 74 connecting the utilization-side space SP2 and the heat-source-side space SP1 and allowing the refrigerant leaked in the utilization-side space SP2 to escape to an external space via the heat-source-side space SP1. Note that, in Modified example 2A, the damper 74 is provided in a space that communicates with the second opening 32, but the damper 74 may be provided in a space on a side where the first opening 31 is arranged.

8-4

In the air conditioner 10 according to the second embodiment, when the standing parts 71 and 72 are made of a member different from the bottom plate 35, the relatively tall standing parts 71 and 72 can be easily formed. In particular, when the standing parts 71 and 72 are made of resin, mass production of the air conditioner 10 becomes easy.

8-5

In the air conditioner 10 according to the second embodiment, when at least one of the standing part 71 or 72 is made of resin and has a shape expanding upward as described in Modified example 2B, it becomes difficult for the refrigerant accumulated at the bottom part of the utilization-side space SP2 to get over the standing parts 71 and 72. Therefore, it is possible to suppress the leaked refrigerant from flowing toward the first opening 31 and the second opening 32 surrounded by the standing parts 71 and 72 over the standing parts 71 and 72. In addition, air can easily flow through a flow path surrounded by the standing parts 71 and 72, and deterioration of performance of the utilization-side heat exchanger 45 due to provision of the standing parts 71 and 72 can be prevented.

8-6

In the air conditioner 10 according to the second embodiment, as shown in FIG. 16, when a height position of the upper end of the standing part 72 is adapted to reach a vicinity of a height position of the lower end of the utilization-side heat exchanger 45, it becomes difficult for the refrigerant accumulated at the bottom part of the utilization-side space SP2 to get over the standing part 72, which can prevent flowing of the refrigerant leaked into the second opening 32 over the standing part 72. For the standing part 71 shown in FIG. 18, a similar effect is obtained when the refrigerant accumulates on the bottom plate 35.

Third Embodiment

(9) Detailed Configuration

Figure 21:
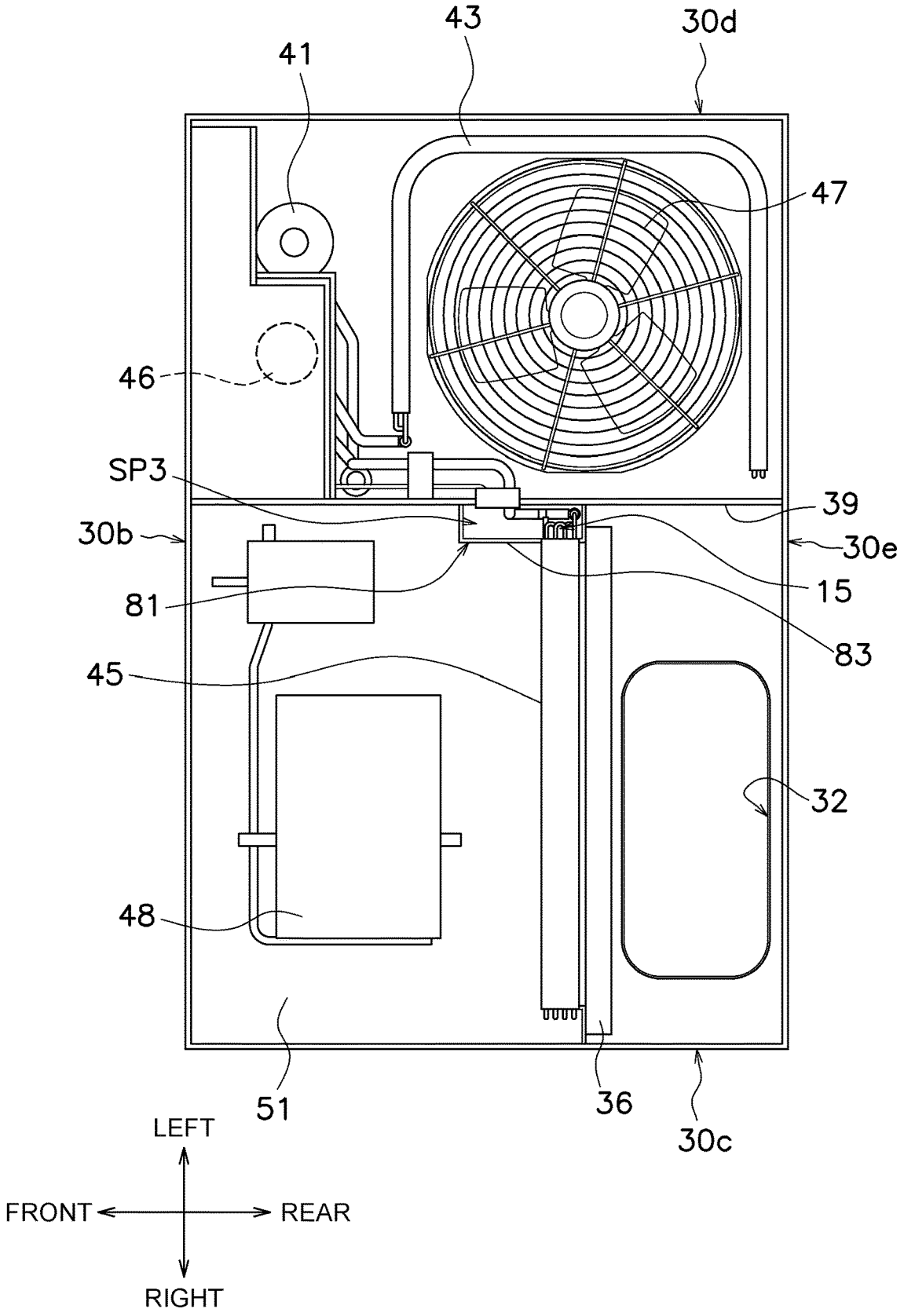
FIG. 21 is a plan view showing an internal configuration of an air conditioner according to a third embodiment.

Next, an air conditioner 10 according to a third embodiment will be described with reference to FIGS. 21 and 22. In the air conditioner 10 according to the third embodiment, a casing 30 has a surrounding part 81 that surrounds a connection-part space SP3 so as to communicate with a heat-source-side space SP1 and not with a utilization-side space SP2. The surrounding part 81 includes, for example, sheet metal 83 and a portion of the casing 30 other than the sheet metal 83. The surrounding part 81 shown in FIGS. 21 and 22 includes a part of a partition plate 39 as a portion other than the sheet metal 83. In the connection-part space SP3, a connection part 15 of a refrigerant pipe is arranged. Examples of the refrigerant pipe having the connection part 15 in the connection-part space SP3 surrounded by the surrounding part 81 include a heat transfer tube 45*a* and refrigerant pipes 12, 13, 45*e*, and 45*f* already described.

Figure 22:
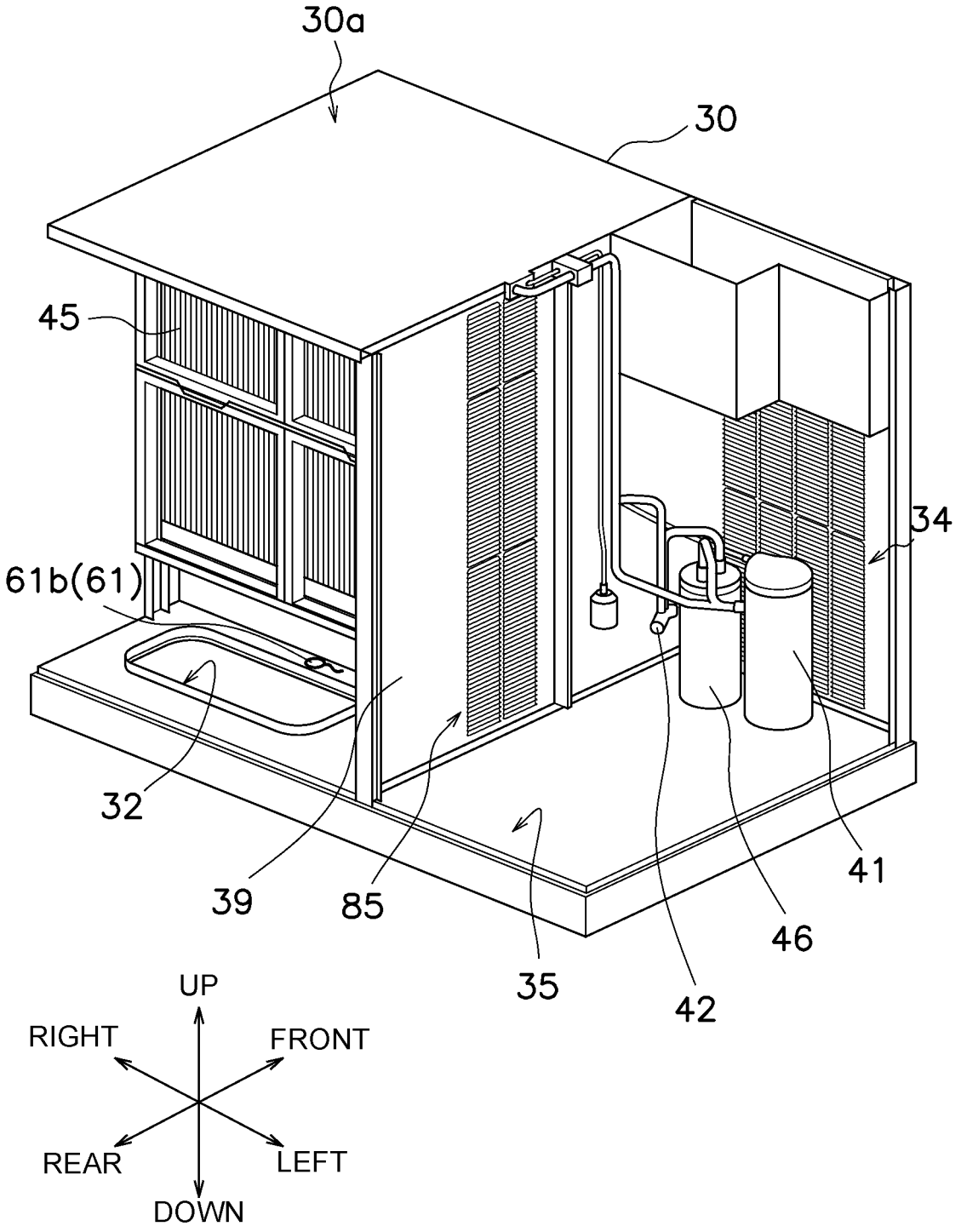
FIG. 22 is a perspective view for explaining an internal configuration of the air conditioner according to the third embodiment.

The partition plate 39 shown in FIG. 22 has a slit 85 in order to connect the connection-part space SP3 and the heat-source-side space SP1. Refrigerant leaking into the connection-part space SP3 is discharged to the heat-source-side space SP1 through the slit 85.

(10) Modified Examples

(10-1) Modified Example 3A

In the air conditioner 10 according to the third embodiment, a description has been made on an example in which the casing 30 has the surrounding part 81 that surrounds the connection-part space SP3 so as to communicate with the heat-source-side space SP1 and not with the utilization-side space SP2. However, when the connection part 15 is near a front surface 30*b*, a back surface 30*e*, or a right side surface 30*c* of the casing 30, a slit may be provided in a metal plate of the front surface 30*b*, the back surface 30*e*, or the right side surface 30*c* of the casing 30, to form the connection-part space.

Figure 23:
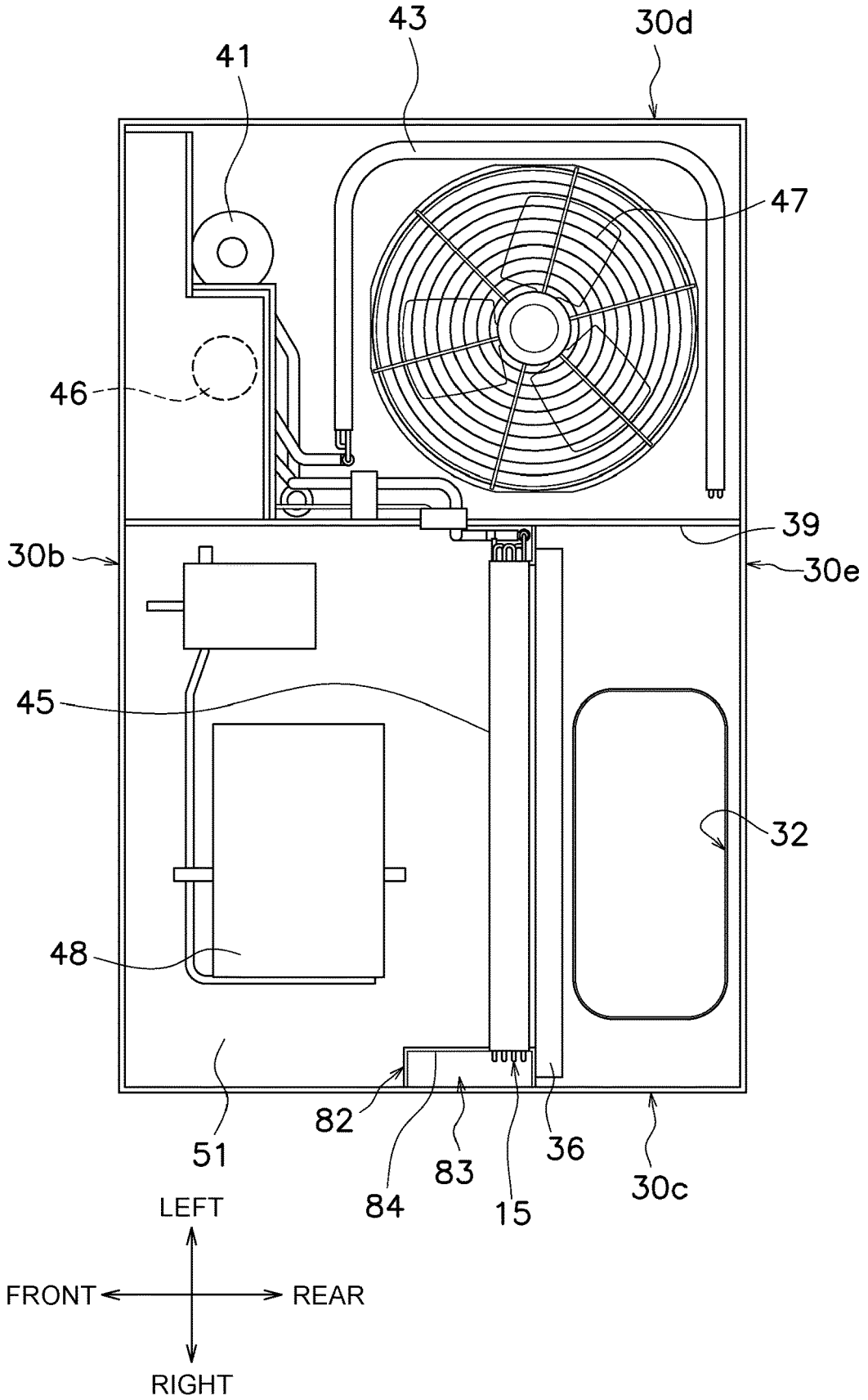
FIG. 23 is a plan view showing an internal configuration of an air conditioner according to Modified example 3A.
Figure 24:
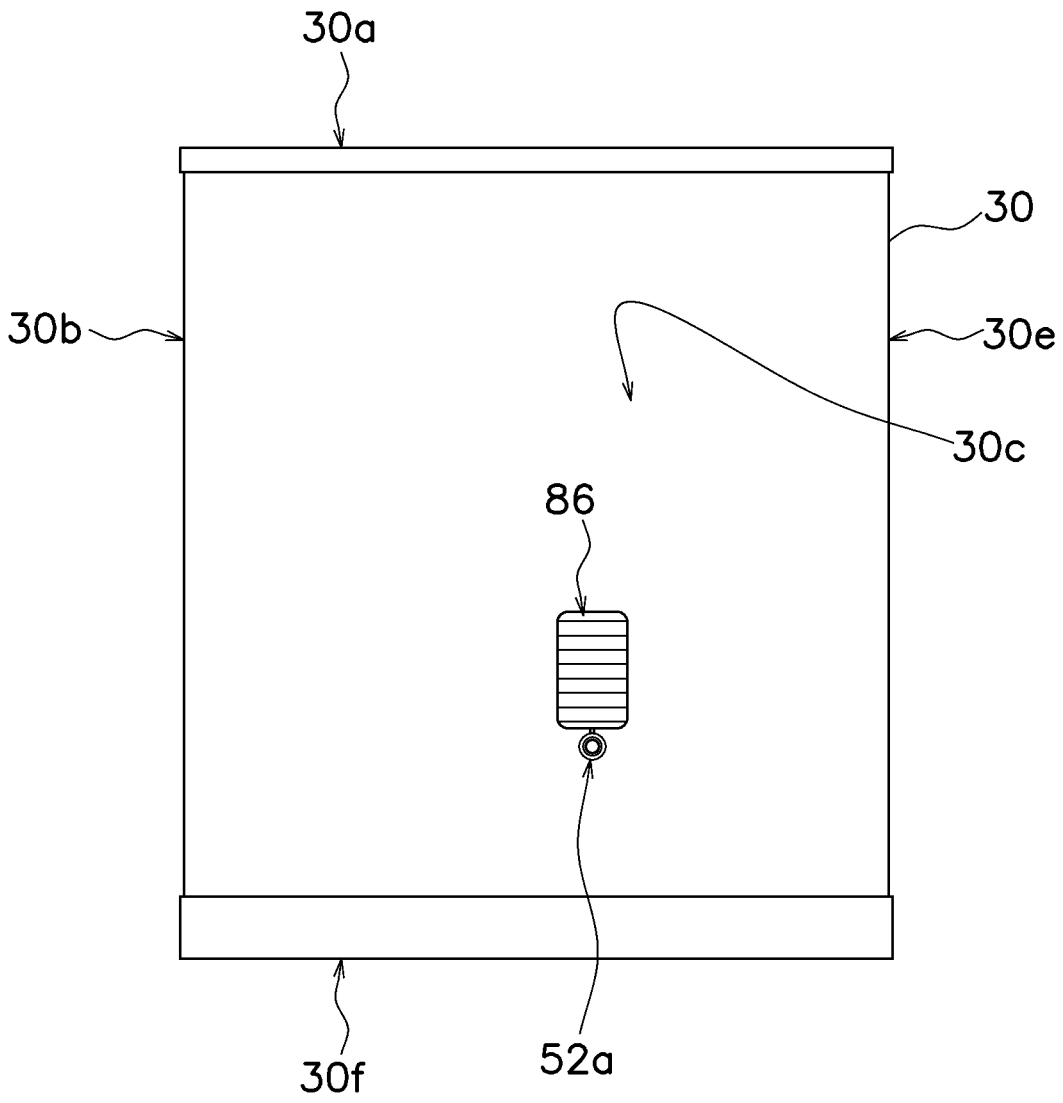
FIG. 24 is a right side view of the air conditioner according to Modified example 3A.

For example, a surrounding part 82 shown in FIG. 23 includes a part of a metal plate of the right side surface 30*c* of the casing 30 as a portion other than sheet metal 84. In the connection-part space SP3, a connection part 15 of a refrigerant pipe is arranged. The partition plate 39 shown in FIG. 22 has a slit 85 in order to connect the connection-part space SP3 and the heat-source-side space SP1. Through the slit 85, refrigerant leaking into the connection-part space SP3 is discharged to the heat-source-side space SP1. Further, a part of the metal plate of the right side surface 30*c* shown in FIG. 24 has a slit 86. Through the slit 86, refrigerant leaking into the connection-part space SP3 is discharged to an external space.

(10-2) Modified Example 3B

In the third embodiment and Modified example 3A, a description has been made on a case where the surrounding parts 81 and 82 are provided on either one of the partition plate 39 and the metal plate of the right side surface 30*c*, but the surrounding parts 81 and 82 may be provided on both. Further, in the third embodiment and the modified example 3A, the surrounding parts 81 and 82 are provided by using the partition plate 39 and the metal plate of the right side surface 30*c* since the utilization-side heat exchanger 45 is arranged so as to extend in the left-right direction. However, when the utilization-side heat exchanger 45 is arranged so as to extend in the front-rear direction, the surrounding parts may be provided with use of the metal plates of the front surface 30*b* and the back surface 30*e* of the casing 30.

(10-3) Modified Example 3C

The damper 74 described in Modified example 2A may be provided in the air conditioner 10 according to the third embodiment. In this case, a main controller 60 may be configured to open the damper 74 to connect the utilization-side space SP2 and the heat-source-side space SP1, and drive the heat-source-side fan 47 to promote exhaust of the leaked refrigerant, when the refrigerant leakage sensor 61 detects refrigerant leakage.

When the refrigerant leakage sensor 61 shown in FIG. 10 detects leaked refrigerant, a signal notifying the refrigerant leakage is transmitted from the refrigerant leakage sensor 61 to the main controller 60. Upon receiving the signal notifying the refrigerant leakage, the main controller 60 sends a command to the drive mechanism 75 of the damper 74 shown in FIG. 19 to open the damper 74 shown in FIG. 18. Upon receiving the command to open the damper 74, the drive mechanism 75 moves the damper 74 from a state where the opening 39*a* is closed by the damper 74 to a state where the opening 39*a* is open. Further, the main controller 60 transmits a command for driving the heat-source-side fan 47, to the heat-source-side fan 47. In this way, by the heat-source-side fan 47 starting blowing air after the damper 74 opens the opening 39*a*, the refrigerant leaked in the utilization-side space SP2 is discharged to the external space outside the casing 30 through the opening 39*a* and the heat-source-side space SP1. As a result, the refrigerant is suppressed from entering the room 210 through the ducts 21 and 22. Further, since the drive mechanism 75 moves the damper 74 described in Modified example 2A to open the opening 39*a* and simultaneously close the second opening 32, the effect of suppressing the refrigerant from entering the room 210 through the ducts 21 and 22 is improved.

Figure 25:
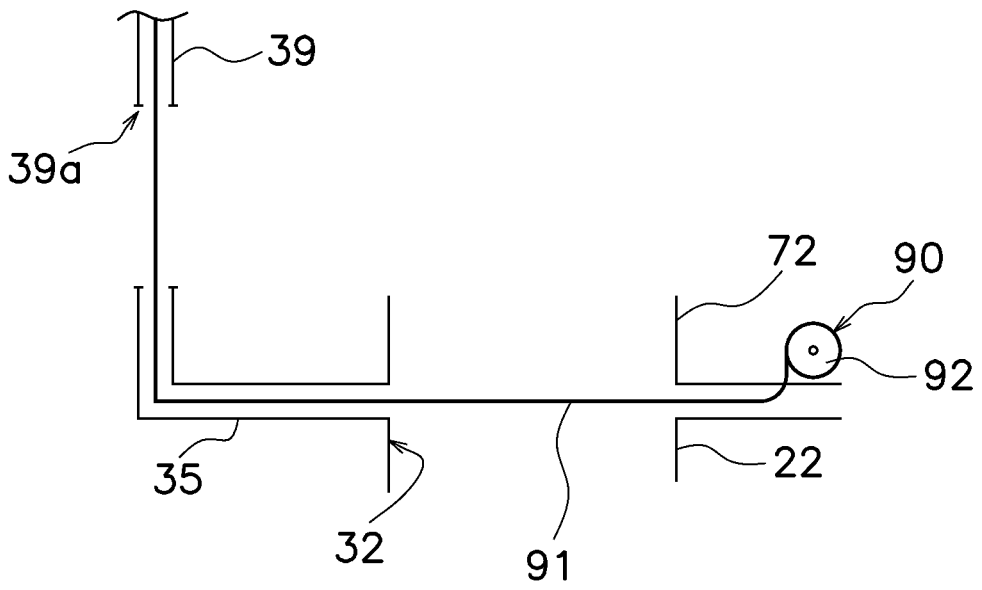
FIG. 25 is an exemplary view for explaining an example of a damper according to Modified example 3C.
Figure 26:
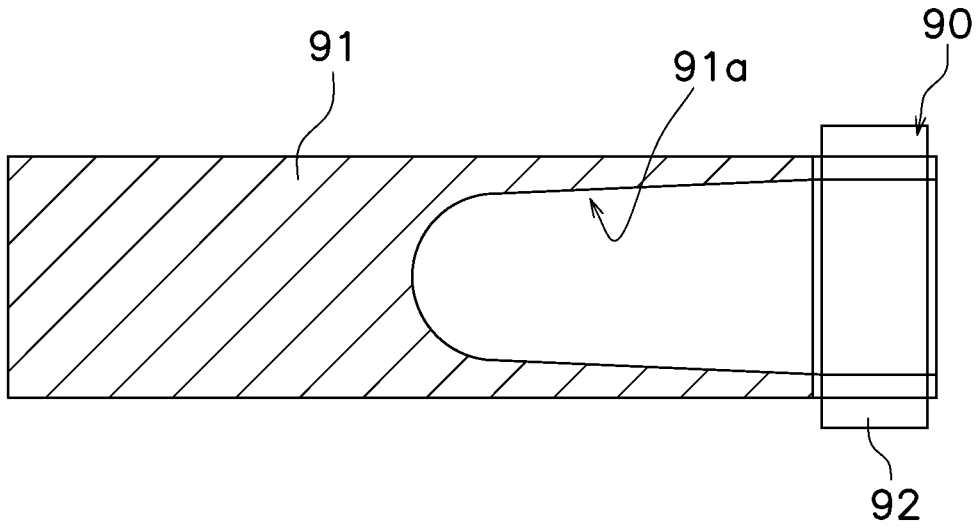
FIG. 26 is an exemplary view for explaining an example of the damper according to Modified example 3C.

Note that, in Modified example 2A, a description has been made on a case where the drive mechanism 75 switches from a state where the damper 74 stands upright to close the opening 39*a* and open the second opening 32, to a state where the damper 74 is laid down to open the opening 39*a* and close the second opening 32, but a sliding damper 90 may be used as shown in FIGS. 25 and 26. The damper 90 includes a resin or metal film 91 shown by hatching, and a winding device 92 that winds the film 91. This winding device 92 is the drive mechanism 75. In a normal state, the second opening 32 is open since the film 91 closes the opening 39*a* of the partition plate 39 while an opening 91*a* of the film 91 and the second opening 32 overlap each other. When the refrigerant leakage sensor 61 detects refrigerant leakage, the main controller 60 issues a command to wind the film 91 to the winding device 92, which is the drive mechanism 75. The winding device 92 winds the film 91 so that the film 91 is removed from the opening 39*a* and the second opening 32 is covered with the film 91. Note that the slide damper 90 can also be applied to the air conditioner 10 according to Modified example 2A.

(10-4) Modified Example 3D

In Modified example 3C, a case where the dampers 74 and 90 are configured to close the second opening 32 has been described. However, the dampers 74 and 90 may be configured to close a first opening 31, and may be configured to close both the first opening 31 and the second opening 32.

(10-5) Modified Example 3E

In Modified example 3C and Modified example 3D, a case where the dampers 74 and 90 connects the utilization-side space SP2 and the heat-source-side space SP1 has been described. However, the dampers 74 and 90 may be configured to connect the utilization-side space SP2 and the external space.

(11) Characteristics 11-1

In the air conditioner 10 according to the third embodiment, at least a part of the connection part 15 is arranged in the connection-part space SP3 that is surrounded by the surrounding part 81 so as to communicate with the heat-source-side space SP1 and not with the utilization-side space SP2, and the connection-part space SP3 that is surrounded by the surrounding part 82 so as to communicate with the external space and not with the utilization-side space SP2. Therefore, even if the refrigerant leaks from a portion of the connection part 15 surrounded by the surrounding part 81, the refrigerant leaked to the external space and/or the heat-source-side space SP1 can escape, which can reduce a possibility of the refrigerant entering the indoor room 210 from the connection part 15 through the utilization-side space SP2 and the ducts 21 and 22. Note that the duct 21 is a first duct extending from the indoor air conditioning target space to be connected to the first opening 31, and the duct 22 is a second duct extending from the indoor air conditioning target space to be connected to the second opening 32.

11-2

In the air conditioner 10 according to the third embodiment, in a case of a configuration in which the dampers 74 and 90 are opened and the heat-source-side fan 47 is driven when the refrigerant is detected by the refrigerant leakage sensor 61 in the utilization-side space SP2, the heat-source-side fan 47 can also generate an airflow from the utilization-side space SP2 through the dampers 74 and 90 toward the heat-source-side space SP1. This makes it possible to suppress the refrigerant from entering the indoor room 210 from the utilization-side space SP2 through ducts 21 and 22.

11-3

In the air conditioner 10 according to the third embodiment, the dampers 74 and 90 are configured to close the first opening 31 and/or the second opening 32 when opened, which makes it possible to prevent the refrigerant from entering indoors through the duct from the first opening 31 and/or the second opening 32 closed by the dampers 74 and 90.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10: air conditioner
11: refrigerant circuit
12, 13, 45*e*, 45*f*: refrigerant pipe
21, 22: duct
30: casing
31: first opening
32: second opening
39: partition plate
43: heat-source-side heat exchanger
45: utilization-side heat exchanger
45*a*: heat transfer tube
61, 61*a*, 61*b*, 61*c*: refrigerant leakage sensor
71, 72: standing part
74, 90: damper
SP1: heat-source-side space
SP2: utilization-side space

The invention claimed is:

1. An air conditioner comprising:
a casing including:
a partition plate that:
separates a heat-source-side space of the casing through which outdoor air passes and a utilization-side space of the casing through which indoor air passes,
blocks airflow between the heat-source-side space and the utilization-side space; and
a bottom plate that:
includes a first opening for supply air and a second opening for return air, and
closes a bottom surface of the utilization-side space;
a heat-source-side heat exchanger in the heat-source-side space that causes heat exchange between a refrigerant and the outdoor air;
a utilization-side heat exchanger in the utilization-side space that causes heat exchange between the indoor air and the heat-exchanged refrigerant;
a first duct that extends from the first opening to a first indoor air conditioning target space;
a second duct that extends from the second opening to a second indoor air conditioning target space; and
a standing part surrounding a periphery of at least one of the first opening or the second opening.

2. The air conditioner of claim 1, wherein the standing part has a height equal to or greater than a value equal to an amount of total refrigerant circulating in the heat-source-side heat exchanger and the utilization-side heat exchanger divided by an area of a portion in the air conditioner where the total refrigerant stays and accumulates.

3. The air conditioner of claim 1, wherein the partition plate comprises a damper that connects the heat-source-side space with the utilization-side space when the damper is open.

4. The air conditioner of claim 1, wherein the standing part is distinct from the bottom plate.

5. The air conditioner of claim 4, wherein the standing part is made of resin and has an upward-extending funnel shape.

6. The air conditioner of claim 1, wherein an upper end of the standing part is within a vicinity of a lower end of the utilization-side heat exchanger.

7. An air conditioner comprising:

a casing including:

a partition plate that:

separates a heat-source-side space of the casing through which outdoor air passes and a utilization-side space of the casing through which indoor air passes, and blocks an airflow between the heat-source-side space and the utilization-side space; and a bottom plate that:

includes a first opening for supply air and a second opening for return air, and closes a bottom surface of the utilization-side space;

a heat-source-side heat exchanger in the heat-source-side space that causes heat exchange between a refrigerant and the outdoor air;

a utilization-side heat exchanger in the utilization-side space that causes heat exchange between the indoor air and the heat-exchanged refrigerant;

a first duct that extends from the first opening to a first indoor air conditioning target space;

a second duct that extends from the second opening to a second indoor air conditioning target space; and a refrigerant pipe disposed in the utilization space, wherein the refrigerant pipe comprises a connection part and is connected to a refrigerant circuit including the utilization-side heat exchanger and the heat-source-side heat exchanger, wherein from a top view of the air conditioner, the connection part is disposed without overlapping with the first opening and the second opening.

8. The air conditioner of claim 7, wherein, from the top view, the refrigerant pipe is disposed without overlapping with the first opening and the second opening.

9. The air conditioner of claim 8, wherein the utilization-side heat exchanger is inclined within the air conditioner.

* * * * *